US011213712B1

(12) United States Patent
Lejuez et al.

(10) Patent No.: US 11,213,712 B1
(45) Date of Patent: Jan. 4, 2022

(54) MULTI-FUNCTION EXERCISE DEVICE

(71) Applicants: Brian S. Lejuez, Bayville, NY (US); John H. Morgan, Lattingtown, NY (US)

(72) Inventors: Brian S. Lejuez, Bayville, NY (US); John H. Morgan, Lattingtown, NY (US)

( * ) Notice: Subject to any disclaimer, the term of this patent is extended or adjusted under 35 U.S.C. 154(b) by 154 days.

(21) Appl. No.: 16/823,570

(22) Filed: Mar. 19, 2020

Related U.S. Application Data

(60) Provisional application No. 62/821,038, filed on Mar. 20, 2019.

(51) Int. Cl.

| | |
|---|---|
| ***A63B 21/04*** | (2006.01) |
| ***A63B 21/00*** | (2006.01) |
| ***A63B 21/055*** | (2006.01) |
| ***A63B 23/02*** | (2006.01) |

(52) U.S. Cl.
CPC ..... *A63B 21/0421* (2013.01); *A63B 21/0428* (2013.01); *A63B 21/0442* (2013.01); *A63B 21/0557* (2013.01); *A63B 21/4047* (2015.10); *A63B 23/02* (2013.01)

(58) Field of Classification Search
CPC ..... A63B 21/02–0557; A63B 21/4047; A63B 23/02–0244
See application file for complete search history.

(56) References Cited

U.S. PATENT DOCUMENTS

| | | | | |
|---|---|---|---|---|
| 3,545,758 A | | 12/1970 | Dellinger | |
| 4,084,815 A | | 4/1978 | Flannery | |
| 4,314,697 A | | 2/1982 | Brumfield | |
| 4,796,881 A | | 1/1989 | Watterson | |
| 4,830,365 A | | 5/1989 | March | |
| 4,844,448 A | * | 7/1989 | Niznik | A63B 21/04 482/40 |

(Continued)

FOREIGN PATENT DOCUMENTS

| | | |
|---|---|---|
| AU | B-24850/95 | 1/1996 |
| WO | WO 2011/005301 | 1/2001 |

OTHER PUBLICATIONS

Press Fit Forces Stress Design Calculator, Jun. 18, 2018, available at: www.engineersedge.com/calculators/machine-design/press-fit/press-fit.htm.

(Continued)

*Primary Examiner* — Jennifer Robertson
(74) *Attorney, Agent, or Firm* — Thomas A. O'Rourke; Bodner & O'Rourke, LLP

(57) ABSTRACT

A exercise device includes: a u-shaped frame; first and second arms pivotally coupled to ends of the frame; a first pair of bands that resist pivotal movement between the u-shaped frame and each of the first and second arms; and an arm bar. The arm bar is releasably coupled proximate to the free end of each of the first and second arms. As configured the device is usable for a first set of exercises. A first end of each of a second pair of resistance bands is respectively secured in proximity to first and second ends of the arm bar. The second ends of the second pair of resistance bands have loops fixedly secured thereto. When the arm bar is not releasably secured to the first and second arms, it is usable in combination with those bands and loops for a second set of exercises, providing a full body workout.

12 Claims, 41 Drawing Sheets

(56) References Cited

U.S. PATENT DOCUMENTS

| | | | | |
|---|---|---|---|---|
| 5,100,131 | A | 3/1992 | Fong | |
| 5,110,122 | A | 5/1992 | Moore | |
| 5,441,473 | A | 8/1995 | Safani | |
| 5,577,987 | A | 11/1996 | Brown | |
| 5,665,041 | A | 9/1997 | Hsieh | |
| 5,681,248 | A | 10/1997 | Vani | |
| 5,702,334 | A | 12/1997 | Lee | |
| 5,728,035 | A * | 3/1998 | Sands | A63B 23/0211 482/132 |
| 5,746,688 | A | 5/1998 | Prager | |
| 5,772,563 | A | 6/1998 | Lin | |
| 5,776,039 | A | 7/1998 | Perez | |
| 5,779,607 | A | 7/1998 | Harris | |
| 5,997,450 | A | 12/1999 | Wilkinson | |
| 6,090,023 | A * | 7/2000 | Liu | A63B 21/0004 482/130 |
| 6,117,057 | A | 9/2000 | Olschansky | |
| 6,206,809 | B1 | 3/2001 | Habing | |
| 6,220,995 | B1 | 4/2001 | Chen | |
| 6,254,517 | B1 | 7/2001 | Kennedy | |
| 6,592,500 | B1 | 7/2003 | McBride | |
| 6,634,998 | B2 | 10/2003 | Siaperas | |
| 6,699,162 | B2 | 3/2004 | Chen | |
| 7,074,165 | B1 | 7/2006 | Hodge | |
| 7,101,328 | B2 * | 9/2006 | Chiu | A63B 21/0004 482/140 |
| 7,137,934 | B2 | 11/2006 | Paramater | |
| 7,361,126 | B2 | 4/2008 | Bruce | |
| 7,381,171 | B2 | 6/2008 | Chen | |
| 8,029,425 | B2 | 10/2011 | Bronston | |
| 8,075,464 | B2 | 12/2011 | Hayes | |
| 8,790,227 | B2 | 7/2014 | Meister | |
| 9,044,641 | B2 * | 6/2015 | Velikin | A63B 21/00047 |
| 9,238,157 | B2 | 1/2016 | Chuang | |
| 9,259,606 | B2 | 2/2016 | Wolan | |
| 9,452,308 | B2 * | 9/2016 | Lentz | A63B 21/1627 |
| 2004/0067830 | A1 | 4/2004 | Rovere | |
| 2005/0143234 | A1 | 6/2005 | Massey | |
| 2007/0135281 | A1 | 6/2007 | Liao | |
| 2007/0281840 | A1 | 12/2007 | Tsai | |
| 2012/0184419 | A1 | 7/2012 | Zhu | |
| 2014/0274603 | A1 * | 9/2014 | Howes | A63B 21/0421 482/127 |
| 2015/0005141 | A1 | 1/2015 | Krahling | |

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.

"Engineering Fit," available at: https://en.wikipedia.org/wiki/Engineering_fit, Jul. 8, 2019.

* cited by examiner

MULTI-FUNCTION EXERCISE DEVICE

CROSS REFERENCES TO RELATED APPLICATIONS

This application claims priority on U.S. Provisional Application Ser. No. 62/821,038, filed on Mar. 20, 2019, the disclosures of which are incorporated herein by reference.

FIELD OF THE INVENTION

This disclosure relates generally to exercise devices, and more specifically it relates to an exercise device that is configured to transform between different configurations to be usable for various different exercises to provide a fully body workout when in use, and to also collapse into a flattened configuration to be easily stored in a small storage space of a home or apartment.

BACKGROUND OF THE INVENTION

Exercise is necessary for people of all ages, and should include both cardiovascular exercises for conditioning of the heart, and strength training for the arm muscles, leg muscles, the core region, not limited to just the abdominal muscles, etc. Such exercises are particularly critical as a person ages, in order to reduce the greater tendency to lose muscle mass and the corresponding loss of motor function.

Many people do not have the time to regularly drive to, and work out at, a public or private fitness/health facility, and many people do not have the extra funds in his/her monthly budget for that repetitive expense, which is particularly true for the elderly. Moreover, many people with a very limited budget do not have an expansive home or apartment within which to store and utilize an assortment of different pieces of home exercise equipment.

There are a number of devices that were designed to exercise the abs (see e.g., U.S. Pat. No. 7,137,934 to Paramater; U.S. Pat. No. 5,776,039 to Perez; U.S. Pat. No. 5,746,688 to Prager; U.S. Pat. No. 5,577,987 to Brown; U.S. Pat. No. 6,254,517 to Kennedy; U.S. Pat. No. 7,381,171 to Chen; U.S. Pat. No. 9,238,157 to Chuang; U.S. Pat. No. 8,790,227 to Meister; U.S. Pat. No. 5,702,334 to Lee; U.S. Pat. No. 6,117,057 to Olschansky; U.S. Pat. No. 5,779,607 to Harris: U.S. Pat. No. 6,206,809 to Habing; U.S. Pat. No. 7,074,165 to Hodge; and U.S. Pat. No. 6,699,162 to chen).

Some such devices may also incorporate and utilize resistance members as part of the apparatus and associated exercises (see e.g., U.S. Pat. No. 4,314,697 to Brumfield; U.S. Pat. No. 5,100,131 to Fong; and U.S. Pat. No. 5,665,041 to Hsieh).

There are also some devices that enable multi-purpose exercising, however they tend to be large stationary pieces of equipment (see e.g., U.S. Pat. No. 4,830,365).

Thus, there is an unmet need for a multi-function exercise device that can provide a total body workout, and which may transform into a compact condition for storage in a modestly sized apartment when not in use. Such a multi-function exercise device is disclosed herein, and provides improvements upon prior art exercise devices.

OBJECTS OF THE INVENTION

It is an object of the invention to provide a multi-function exercise device capable of transforming to provide a total body workout.

It is another object of the invention to provide a multi-function exercise device with an adaptive workout bar built into the device to allow for abdominal exercises and a multitude of additional exercises.

It is a further object of the invention to provide a multi-function exercise device with elastic bands or springs to provide increased resistance for a user while doing a multitude of different exercises.

It is another object of the invention to provide a multi-function exercise device with an adaptive workout bar configured to transform by telescoping to be used a separate workout bar.

It is also an object of the invention to provide a multi-function exercise device with an adaptive workout bar that may be usable for abdominal exercises and that may transform into a flat workout bar usable for additional exercises.

It is another object of the invention to provide a multi-function exercise device that may fold flat to reduce its overall size and allow for storage in a smaller volume of space that is utilized while exercising with the device.

It is also an object of the invention to provide a multi-function exercise device that may use crisscrossing resistance bands connected from inside portion to an outside portion of the device to prevent the device from getting stuck in down position.

It is a further object of the invention to provide a multi-function exercise device that may use resistance bands or springs to provide assistance in lifting the user's legs while performing abdominal exercises.

It is also an object of the invention to provide a multi-function exercise device that that may transform from a folded flat position and lock in an exercise position.

It is a further object of the invention to provide a multi-function exercise device that may have an arm bar and leg bar with attached adjustable resistance bands for user to perform different exercises.

It is also an object of the invention to provide a multi-function exercise device that provides assistance in doing leg lifts, leg curls, leg raises, leg pull-ins, crunches and other exercises.

It is a further object of the invention to provide a multi-function exercise device that may provide adjustable resistance levels.

It is also an object of the invention to provide a multi-function exercise device that may have a foam neck rest and rubber base grips to prevent slipping.

It is a further object of the invention to provide a multi-function exercise device that may have resistance bands attached to a telescoping bar, which bands can be wound around the bar for storage and unwound when utilized for exercising.

It is also an object of the invention to provide a multi-function exercise device that may include male and female resistance band connection interfaces.

It is a further object of the invention to provide a multi-function exercise device that may provide an arm bar to connect to an abdominal device using straps or other connection apparatus.

It is also an object of the invention to provide a multi-function exercise device that may have a workout bar usable for different exercises that easily attaches and detaches from a device used for abdominal exercises.

It is a further object of the invention to provide a multi-function exercise device that may use removable resistance bands to allow for folding the device into a flattened condition.

It is also an object of the invention to provide a multi-function exercise device that may use guided telescoping bars on an arm bar to allow for easy transformation to flat bar. Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

An exercise device having an attached adaptive exercise bar, a straight adaptive exercise bar used for additional exercises with separate resistance bands, and a means for folding the exercise device flat.

The exercise device is a metal or plastic structure made from steel, ABS plastics or similar material. The function is to assist a user in doing a multitude of exercises that may form a total body workout. Resistance bands connected to the steel or plastic structures provide both resistance and assistance to the user. One side of the exercise device is connected to the adaptive exercise bar. The steel or plastic structures are connected by various conventional connection mechanisms.

The exercise device permits a multitude of exercises to be performed, as shown in FIG. 1. An arm bar acts as leverage for exercises and also functions as an adaptive telescoping exercise bar for additional exercises. The arm bar may have a foam cushion to provide comfort when doing certain exercises. A leg bar is connected to the arm bar and allows the user to perform abdominal workouts. Resistance bands allow the leg bar to retract to the upright position. Putting pressure on the leg bar brings it to a down position, and also allows for assistance in lifting the user's legs when retracted to the up position. The resistance bands may crisscross from inside to outside to prevent the device from getting stuck in the down position. The resistance bands may be adjustable on the leg bar or arm bar to allow for different levels of resistance. The resistance bands may be adjustable by using different height notches connected to the arm bar. A locking mechanism may be used to keep the device in a stationary position while doing certain exercises. The telescoping bar may contract and expand out of the arm bar. A pair of resistance bands may be connected to the telescoping bar and/or the arm bar and may unravel, and/or attach and detach from the bar for use in additional exercises. The arm bar may be releasably secured to a lower portion of the device using straps or other securement method.

Design of the device may be different than shown in FIG. 1. The device may have adjustable resistance bands. The resistance bands may connect to the arm bar using one of a plurality of notches in the arm bar. One side of resistance band may be stationary while the other side can be adjusted to be held in one of the plurality of notches to change the amount of resistance. The locking mechanism may consist of door style springs and allows the device to lock in place to act as safety mechanism. By collapsing the spring locking mechanism, the device can fold flat. Alternatively, the device may use folding mechanism as explained in third main element. The leg bar and arm bar may each have a cushion/padding thereon for comfort. The resistance bands may wrap around a telescoping bar and/or the arm bar and may have clips to keep resistance band raveled around the bar. Alternatively, the resistance bands will be able to be attached and detached as shown in FIG. 4. The resistance bands may also detach from the leg bar to allow the device to fold flat. The exercise device may also contain a rubber base at one or more locations to prevent slipping during use.

An adaptive exercise bar may be a metal structure made from steel or similar material having a first end and second end. The adaptive exercise bar may connect to the leg bar using any suitable general connection apparatus. The adaptive exercise bar structure may in one embodiment include a main bar and two telescoping internal bars made of metal or similar material to allow it to transform into a longer straight bar. Telescoping bar may be attached to the main bar using general connection and locking methods. The function is to allow the main bar with two telescoping bars to be connected to the leg bar of the exercise device for one set of exercises (e.g., abdominal exercises) and also function as a separate exercise device for a second set of exercises.

An adaptive exercise bar may function as an arm bar and separate flat exercise bar. Adaptive exercise bar disconnects from abdominal exercise device to create new resistance band device. Telescoping bars contract and expand from within adaptive exercise bar to form longer flat bar. Telescoping bars will snap into position using retracting button or similar method. Resistance bands can be unraveled or separately attached to telescoping bar to allow for a multitude of additional exercises. Resistance bands may also wrap around telescoping bars to allow for variable resistance. Foot straps allow user to place feet inside and keep resistance bands stationary while holding adaptive exercise bar in hands.

Design of device may be different as shown in FIG. 2. Telescoping bars may have guided feature to allow for easy expansion into longer bar. Adaptive exercise bar may have cut-out in bar, crimps or specific shape to allow for guided telescoping bars. Adaptive exercise bar and telescoping bars may be in a triangle, oval, hexagon shape or similar design to allow for guided expansion of bars. Foot straps may have attached clip to allow resistance bands to remain wrapped around telescoping bar. Adaptive exercise bar may lock onto abdominal exercise device using straps or other locking method. Additionally, resistance bands may attach and detach using interface as shown in FIG. 4.

A folding mechanism is a metal structure made from steel or similar material. The function is to allow arm bar to fold down and become parallel with leg bar. Hinge mechanism is connected to arm bar and stationary metal object for connecting both arm bar and leg bar.

A folding mechanism to allow abdominal exercise device to fold flat for easy storage. Hinge mechanism allows arm bar to fold down and become parallel to leg bar. Using a pin or similar locking mechanism, arm bar remains locked in stationary position and is ready for use. Removing pin from locking mechanism allows device to fold flat for storage.

Design of device may be different as shown in FIG. 3. Instead of using hinge and locking mechanism, device may have simple resistance band release on Leg Bar as explained in FIG. 5. Folding mechanism may also have steel or plastic blocking mechanism to prevent leg bar from folding too close to arm bar. Only when pin is pulled from locking mechanism or resistance band is released can device be folded down and leg bar come in touch with arm bar.

Resistance band connection interface is a plastic structure having two interconnecting pieces. Female connector may be attached to telescoping bar and allow for easy connection of male connector. Male connector and female connector may connect using general connection methods such as a snap on, snap off feature. The function is to allow for easy attachment and detachment of the resistance bands. Resistance band may be directly connected to male connector. Arm Bar connector may be attached to telescoping bar using general connection methods. The function of Arm bar connector is to allow for easy placement of telescoping bar into abdominal exercise device.

A Resistance Band Connection Interface to allow for attaching and detaching resistance bands. Male connector may house resistance band strap and attach directly to female connecter on telescoping bar. Male connector and female connector may connect by clip or similar method. Male connector may detach easily from female connector by simple press release or similar method. Male connector may slide over or within telescoping bar. Arm bar connector allows for easy attachment to Abdominal Exercise Device.

The adjustable resistance band method is a plastic structure having a first end and second end. Resistance bands will connect to first end through adjustable notches. Resistance bands will connect to second end and be stationary. The function is to allow both resistance and assistance to user. User can use notches to adjust tension between arm bar and leg bar to allow for adjustable difficulty levels. Resistance bands are connected to arm bar and leg bar using various conventional connection mechanisms.

An Adjustable Resistance Band Method may allow for multiple levels of resistance. Notches allow resistance bands to be adjusted up and down for different tension levels. Notches may be molded into arm bar or leg bar. Resistance Band may be connected to one end without using notches and allow for simple disconnection to allow for folding device flat.

The adaptive exercise bar is connected to the abdominal device as illustrated in FIG. 1 of the drawings. Adaptive exercise bar may connect to abdominal exercise device using rubber straps or other various conventional attachment methods utilized to manufacture exercise equipment.

The adaptive exercise bar is part of the complete abdominal exercise device as illustrated in FIG. 1. Adaptive exercise bar is in communication with abdominal exercise device but may be removed from abdominal exercise device to become separate exercise bar.

The folding mechanism is the connection means between arm bar and leg bar as illustrated in FIG. 3. The connected hinge and locking mechanism are attached to arm bar and leg bar via various conventional attachment methods.

The resistance band connection interface is part of the adaptive exercise bar as shown in FIG. 4. The female connector is attached to the telescoping bar while the resistance band is connected to the male connector. Male connector and female connector come in direct communication to allow for easy attachment and removal from telescoping bar. Male connector and female connector are attached to telescoping bar via various conventional attachment methods.

Alternatively, abdominal device may use springs to assist user in exercises instead of resistance bands.

User starts by placing legs on leg bar and holding arm bar and adaptive exercise bar as shown in FIG. 1 of the drawings. User then leans back while still keeping legs on leg bar and hands on arm bar. Now on their back, user begins pushing legs down on leg bar against resistance of resistance band. Leg bar extends to down position and then retracts to up position, activating resistance bands. With each successive repetition, resistance bands extend and retract to original position, assisting user in numerous abdominal exercises. Arm bar also extends and retracts to original position.

For additional exercises, user will remove Adaptive exercise bar from the exercise device as shown in FIG. 2 of the drawings. User then extends telescoping bars from adaptive exercise bar to form longer bar. Now as a separate exercise bar, user unwinds or connects resistance bands to telescoping bar and places feet in foot straps. Now device is ready to be used as separate exercise bar for a multitude of additional exercises. For increased resistance, resistance bands can be wrapped around bar by turning adaptive exercise bar. User can also use resistance band connection interface to place various resistance band strengths on adaptive exercise bar.

To fold the device, the user removes pin from locking mechanism and pushes arm bar down towards leg bar. When user is ready to use device again, arm bar folds up and is locked back into place by sticking pin in locking mechanism. Alternatively, user may simply release resistance band from leg bar to allow device to fold.

BRIEF DESCRIPTION OF THE DRAWINGS

The description of the various example embodiments is explained in conjunction with appended drawings, in which.

DETAILED DESCRIPTION OF THE INVENTION

Figure 1:
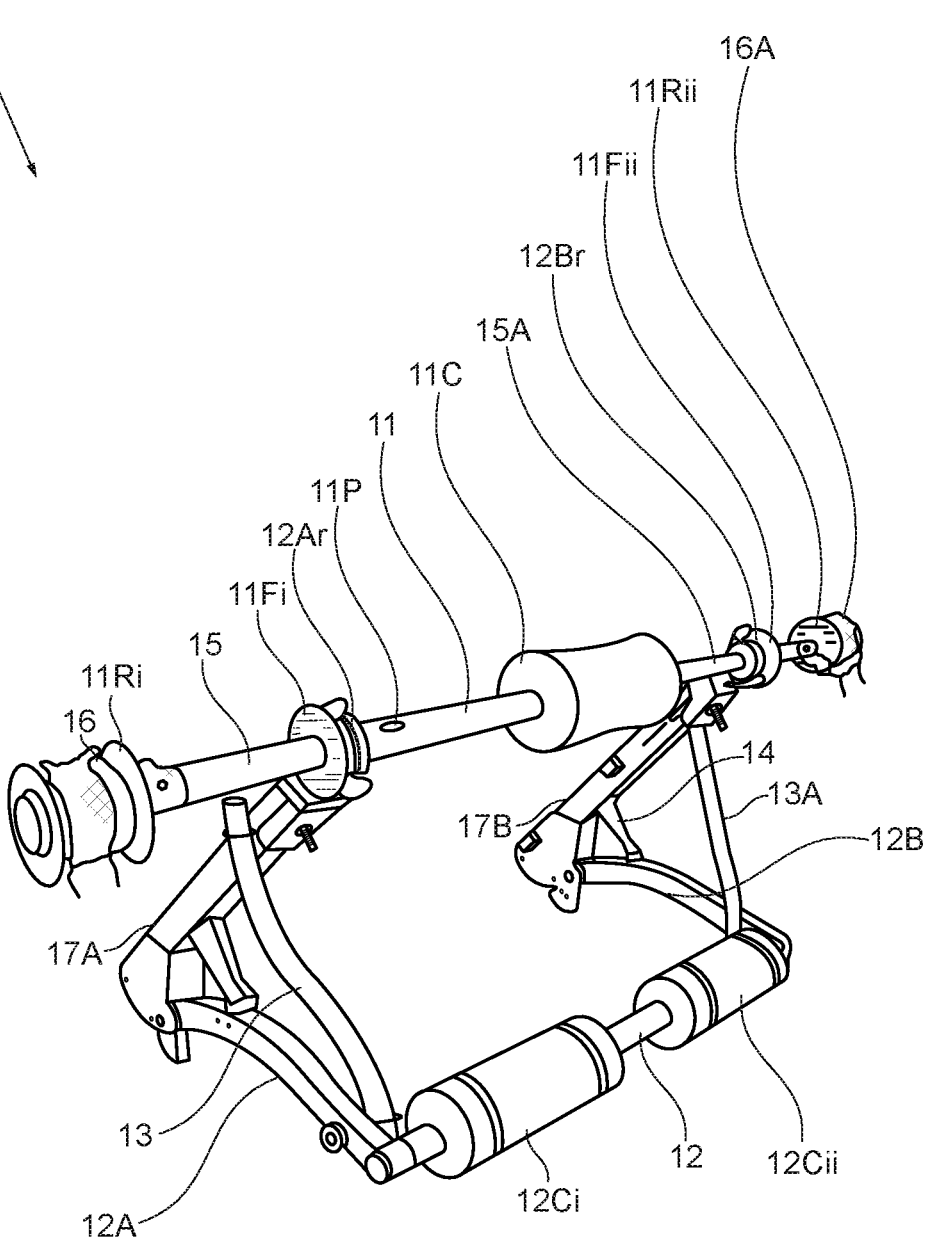
FIG. 1 is a perspective view of a first embodiment of a multi-function exercise device, with the device shown having its cross-wise positioned arm bar releasably secured to the first and second pivotal support arms of the frame, that are themselves support by u-shaped member consisting of a first leg, a second leg, and a leg bar between a first end of each of the first and second legs, with a first pair of resistance bands biasing the arm bar and the first and second pivotal arms toward the leg bar.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the disclosed and/or claimed apparatus/method.

Furthermore, any reference made throughout this specification to "one embodiment" or "an embodiment" means that a particular feature, structure or characteristic described in connection therewith is included in at least that one particular embodiment. Thus, the appearances of the phrases "in one embodiment" or "in an embodiment" in various places throughout this specification are not necessarily all referring to the same embodiment. Therefore, the described features, advantages, and characteristics of any particular aspect of an embodiment disclosed herein may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: https://en.wikipedia.org/wiki/Engineering_fit; and "Three General Types of Fit," available at www.mmto.org/dclark/Reports/Encoder%20Upgrade/fittolerences%20%5BRead-Only%5D.pdf.

The terms "rigid," and "flexible," and "resilient" may be used herein to distinguish characteristics of portions of certain features of the exercise device. Use of the term "rigid" indicates that the described element is devoid of flexibility such that it does not readily lose its overall shape when a force is applied by hand. Use of the term "flexible" indicates that the described element is capable of repeated bending such that it may be bent into different shapes and does not retain a general shape, but instead readily deforms when force is applied. Use of the term "resilient" indicates that the described element has such flexible features and also has a tendency to return to its initial general shape without permanent deformation once a force that causes such flexure is removed. Use of the term "semi-rigid" indicates that the described element may have some degree of flexibility or resiliency.

It is further noted that any use herein of relative terms such as "top," "bottom," "upper," "lower," "vertical," and "horizontal" are merely intended to be descriptive for the reader, and may be based on the depiction of those features within the figures for one particular position of the apparatus, and such terms are not intended to limit the orientation with which the disclosed apparatus may be utilized.

A first embodiment of a multi-function exercise device 10 as disclosed herein is shown in FIG. 1, and includes an arm bar 11 releasably coupled to a frame, where the frame includes a pair of arms 17A and 17B, a u-shaped member, and a pair of resistance members.

The u-shaped member is shown resting on the ground in FIG. 1, with the u-shape being formed of a leg bar 12 extending between a first end of each of a first leg 12A and a second leg 12B. The leg bar 12 and the first and second legs 12A and 12B may be formed as a single bent-up part (e.g., a bent up bar/rod), or may alternatively be formed as three separate parts that are jointed together mechanically, as shown in FIG. 1. At least the leg bar 12 may preferably be formed as a cylindrical rod member to be more comfortable when the user may place his/her hands and/or legs in contact therewith. In addition, a foam cushion may be positioned on at least a portion of the leg bar 12, and in one embodiment one hollow cylindrical cushion may be positioned on the cylindrical leg bar 12, which cushion may extend part way across the leg bar or across the entirety of the leg bar, and in another embodiment two hollow cylindrical cushions 12Ci and 12Cii may be positioned on the cylindrical leg bar 12, as shown in FIG. 1. The arm bar 11 may similarly have a cushion positioned thereon, and in one embodiment it may be the cushion 11C shown in FIG. 1.

A corresponding pair of arms 17A and 17B may be pivotally coupled to second ends of the first leg 12A and second leg 12B, respectively. At least a portion of the arm bar 11, the arms 17A and 17B, and the u-shaped frame may be made of any suitable rigid material, including not limited to a metal (e.g., steel, aluminum, etc.), wood, a plastic (e.g., ABS—Acrylonitrile butadiene styrene), a composite material, e.g., polypropylene 30% glass fiber, etc. A bottom portion of the arms 17A and 17B may be rounded to permit easier pivoting of the device on the floor/ground during certain exercises (see e.g., FIGS. 26B-26C). Also, a lower portion of each of the arms 17A and 17B and of the u-shaped frame that may contact the floor/ground (see FIG. 26A) may be formed of a rubber material or may have a rubber pad or another non-slip material secured thereto to prevent slipping during use.

Figure 14:
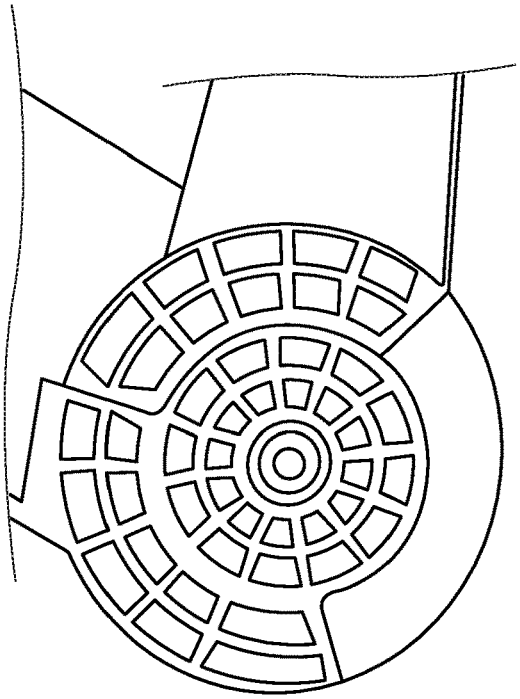
FIG. 14 is the side view of FIG. 13, but with a portion thereof enlarged to show engagement of a first pair of stop surfaces on one leg and the corresponding arm at the pivotal connection therebetween.
Figure 15:
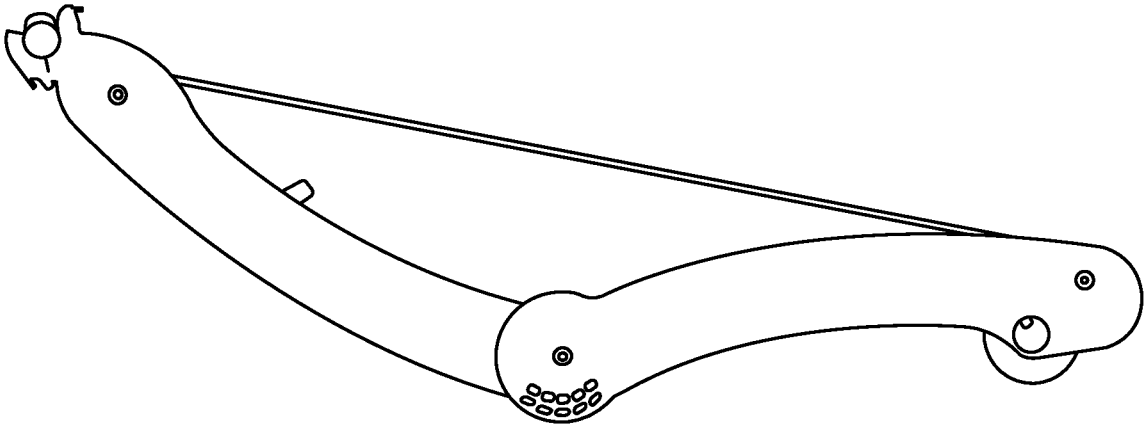
FIG. 15 is the side view of FIG. 13, but is shown with the first and second legs and leg bar pivoted relative to the corresponding arms to be in a lowered position that may be reached while the user is doing leg pull-in exercises or leg lift exercises.
Figure 17:
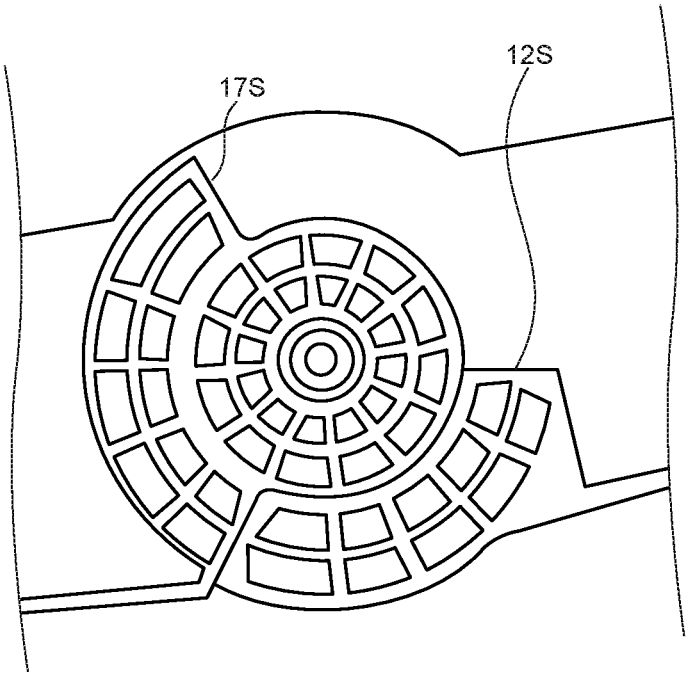
FIG. 17 is the side view of FIG. 16, but with a portion thereof enlarged to show engagement of the second pair of stop surfaces on the one leg and the corresponding arm at the pivotal connection therebetween.
Figure 18:
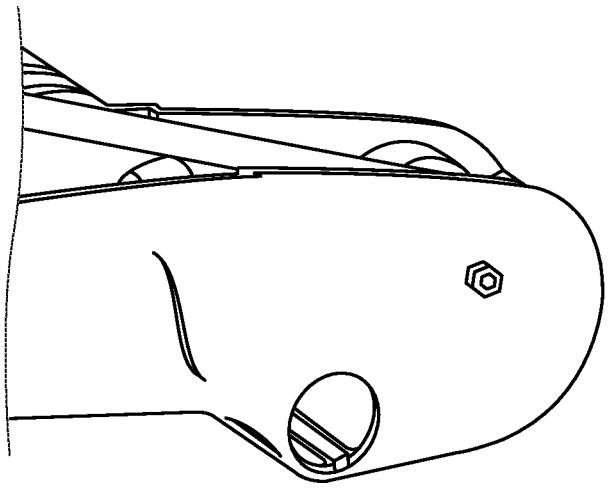
FIG. 18 is a perspective view of the one leg and the leg bar as shown in FIG. 16, but also showing the resistance band being wrapped around a cylindrical member.
Figure 19:
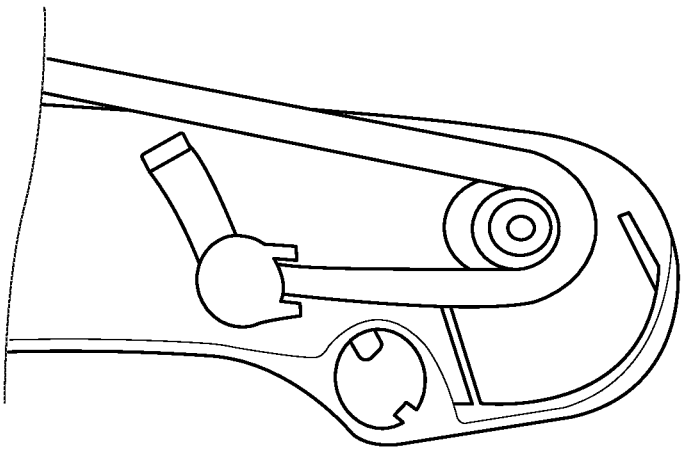
FIG. 19 is a side cross-sectional view of the first leg and the leg bar as shown in FIG. 16, but also showing the resistance band being wrapped around a cylindrical member and secured within a recess of the arm.
Figure 19A:
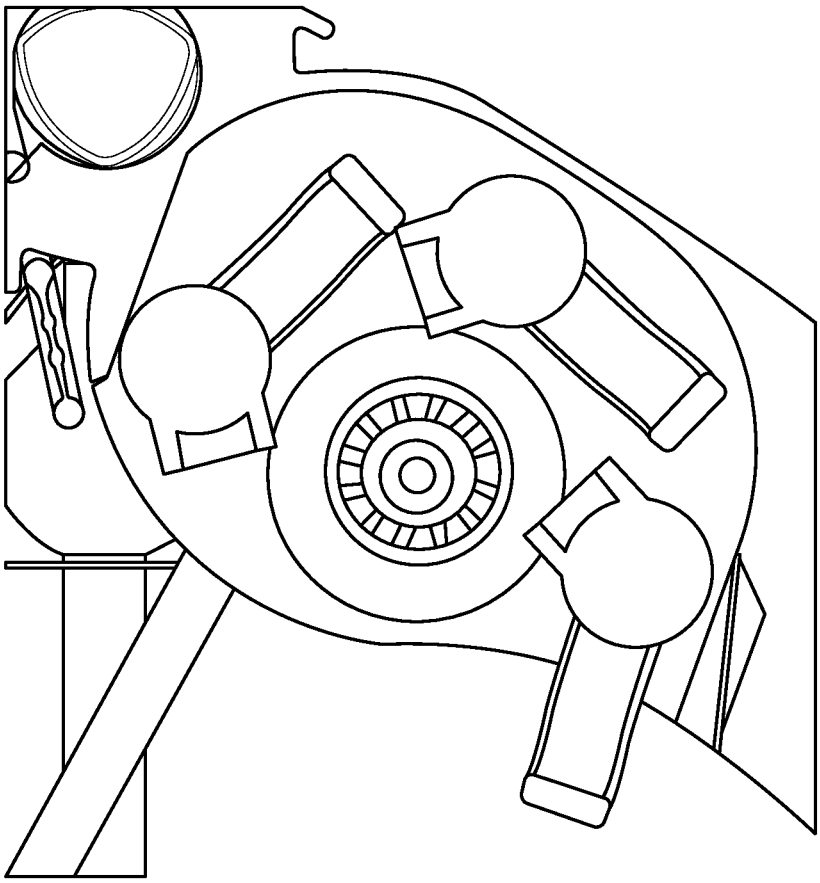
FIG. 19A shows the end of the arm bar, and a portion of the resistance band at that end after being released and allowed to hang downwardly.

A post 14 may protrude from a portion of each of arms 17A and 17B to act as a stop to inhibit pivotal movement of the arms in one direction so that they may be at least at an acute angle to the first and second legs 12A and 12B. In one embodiment the acute angle may be in the range of 36-54 degrees, and in another embodiment the acute angle may be in the range of 39-51 degrees, and in yet another embodiment the acute angle may be in the range of 42-48 degrees. In other embodiments other ranges may alternatively be used. The post 14 may serve as a kick back safety mechanism, which may prevent the arm bar 11 during a particular exercise (see e.g., FIG. 26C) from snapping backwards and forcibly contacting/injuring the user, due to the biasing provided by the resistance bands 13/13A, if the bar were inadvertently released from the user's grasp. This feature may also serve to maintain the arms 17A/17B, and thus the arm bar 11 in an upright position, ready for use in one of several ab exercises, and may also prevent the resistance bands from getting tangled/stuck if the arm bar 11 were to be pushed all the way down in proximity to the leg bar 12. This functionality may also be provided by a stop surface on one or more of the arms (e.g., surface 17S in FIG. 17) and a corresponding stop surface on one or more of the legs (e.g., surface 12S), which may limit travel therebetween (see FIG. 14).

Figure 3:
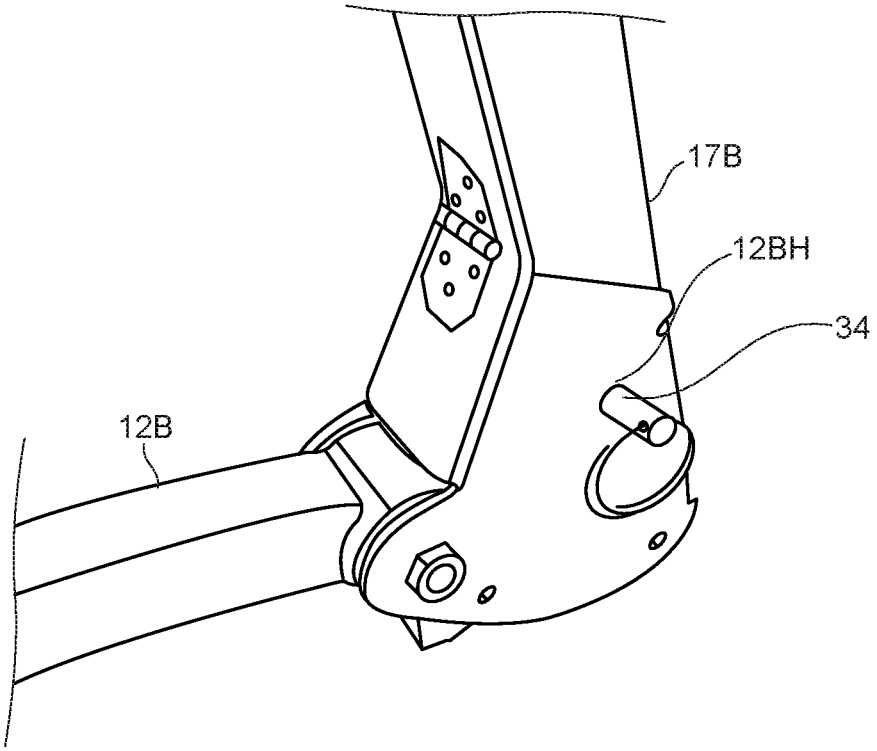
FIG. 3 is a perspective view of the joint between the first leg of the frame and the corresponding pivotal arm, shown with a pin inserted into a hole in both members to inhibit pivotal travel of the arm with respect to the first leg in at least one pivotal direction.

Additionally, or alternatively, a pin 34 (see FIG. 3) may be inserted into a hole (e.g. hole 12BH) in one of the arms (e.g., arm 17B) and into a corresponding hole in a portion of the leg to which it is pivotally coupled (e.g., leg 12B), to inhibit pivotal movement between the arm and leg in both directions, for use during certain exercises. The pin 34 may be quickly removed to permit such pivotal movement for other exercises. In an embodiment where the post 14 is not utilized, the pin 34 may be quickly removed to permit folding of the device for storage, whereby, the user removes the pin and pushes the arm bar 11 down towards the leg bar 12. When the user is ready to use the multi-function exercise device 10 again, the arm bar 11 is manually pivoted up and is again restrained from subsequent pivoting by placing the pin(s) 34 being placed back into the hole(s) (e.g. hole 12BH). The pin 34 may contain a ball that is spring biased transversely to the axis of the pin to act as a detent (see U.S. Pat. No. 6,016,594 to Frey), to prevent the pin from falling out due to movement of the device 10 while being used for certain exercises.

A portion of each of the arms 17A and 17B being proximate to, or at its distal end may be formed with a recess (e.g., recess 12Ar and recess 12Br in FIG. 1), with those recesses being configured to respectively receive a portion of the arm bar 11 therein. The shape of the recesses and the cross-sectional shape of those portions of the arm bar 11 may be any suitable shape and corresponding shape, including but not limited to a rectangular shape, an elliptical shape, an irregular shape, etc. In one embodiment, those portions of the arm bar 11 may be cylindrical, and therefore the surface of the recesses 12Ar and 12Br may be a portion of a cylinder (i.e., a cylinder surface segment). In one embodiment, the recesses 12Ar and 12Br may be formed to be slightly larger than the corresponding cylindrical portions of the arm bar 11, to be received therein in a clearance fit (i.e., the radius of the cylinder surface segment of the recess may be larger than the radius of the corresponding portion of the arm bar). A pair of flanges 11Fi/11Fii, which flanges may be annular, may be secured to, or may integrally formed on the arm bar, as seen in FIG. 1, to prevent the arm bar 11 from sliding laterally within those recesses with respect to the arms 17A and 17B.

Figure 12:
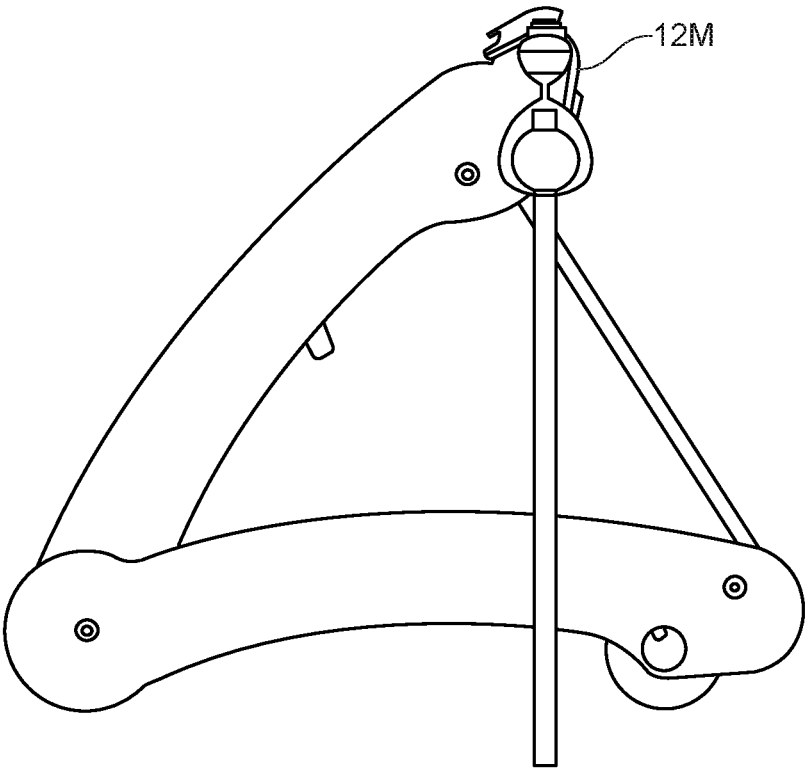
FIG. 12 is a side view of the multifunction exercise device, showing one of the resistance bands of the arm bar after being released permitting it to hang downwardly.
Figure 13:
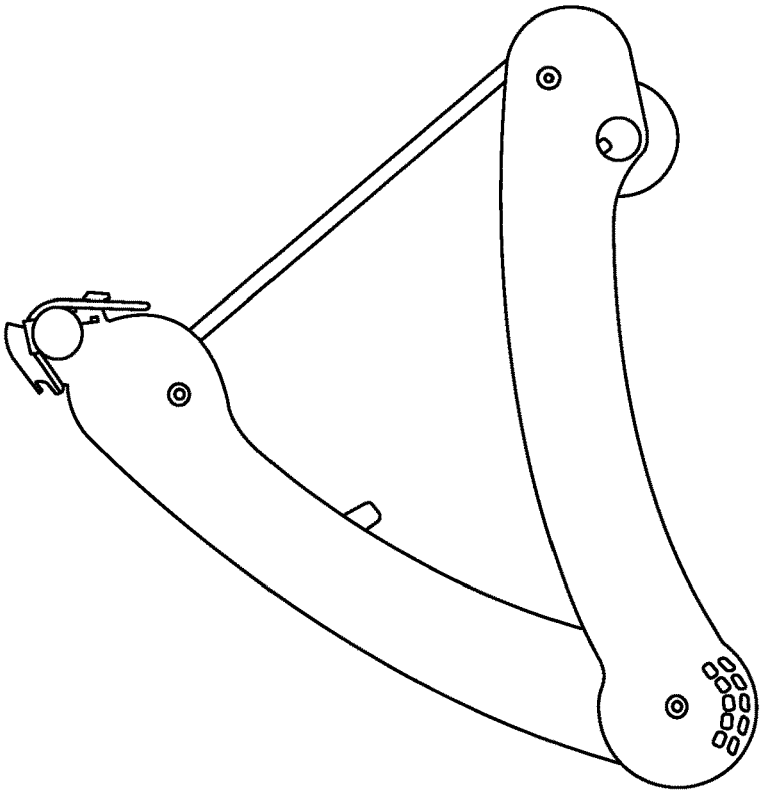
FIG. 13 is the side view of FIG. 11, shown on a floor surface and rotated into a position at which a user may begin doing leg pull-in exercises or leg lift exercises for the abdominal muscles.
Figure 16:
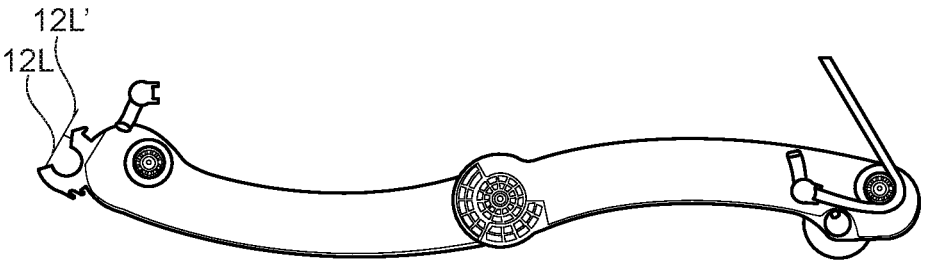
FIG. 16 is the side view of FIG. 13, but is shown with the resistance bands detached, and with the first and second legs and leg bar pivoted relative to the corresponding arms until being inhibited from further rotation by a second pair of stop surfaces.
Figure 20:
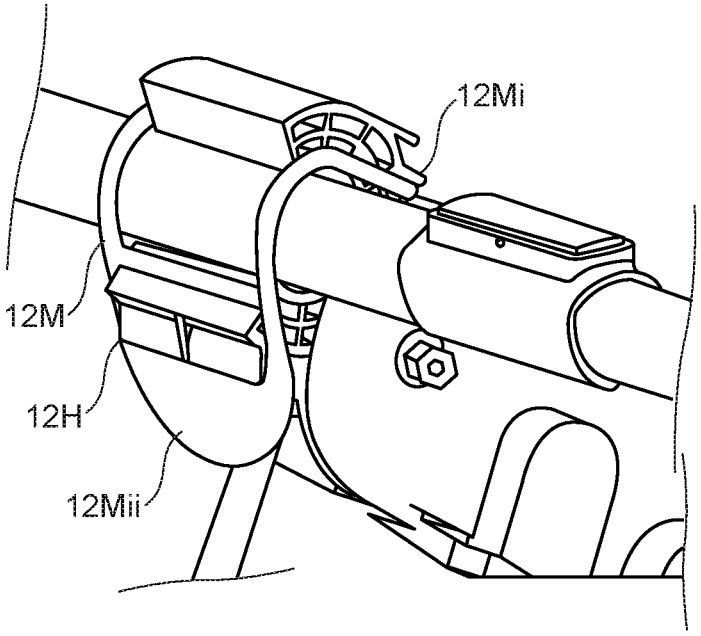
FIG. 20 is a perspective view of a first latch member that may be used to releasably secure the arm bar to the corresponding arm.
Figure 21:
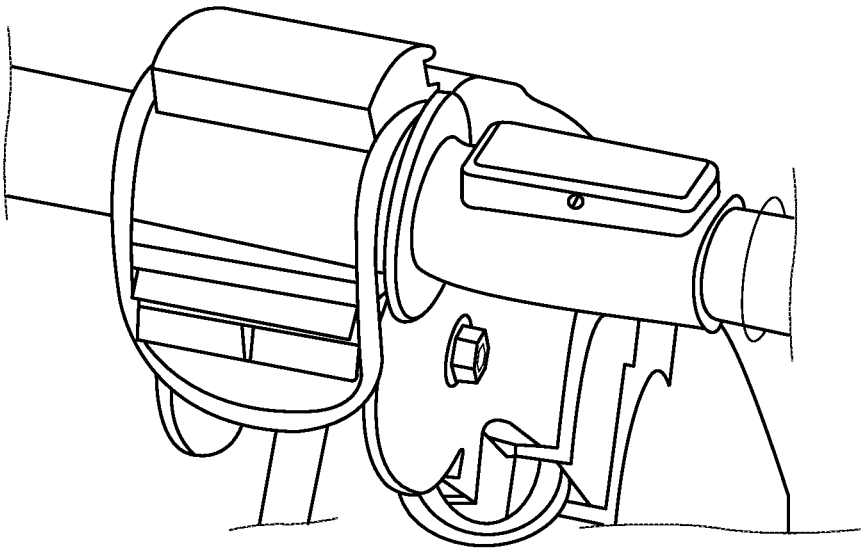
FIG. 21 is a second perspective view of the latch member shown in FIG. 20.

In another embodiment, to provide for releasable coupling of the arm bar 11 to the arms 17A and 17B, the recesses may be formed to be slightly smaller than the corresponding cylindrical portions of the arm bar 11, for the arm bar to be received therein in a friction fit. In yet another embodiment, the beginning of each of the recesses 12Ar and 12Br (i.e., each of the sides of that openings) may be formed with a small protrusion, which protrusion may be an elastic material that the arm bar 11 may compress in order to snap into the recess, to be releasably retained (i.e., "latched") in that retained position. In another embodiment, as shown in FIG. 16, a latch member 12L may be rotatably coupled to one of the sides of the recess, and may be rotated into a first position to retain the arm bar within the recess, or may be rotated away to the dashed line position 12L' shown in that figure to permit removal of that portion of the arm bar from the recess. In yet another embodiment shown in FIGS. 12 and 20-21, the latch may be formed by having a flexible member 12M (e.g., being made of a flexible plastic or rubber material, or a composite material, e.g., polypropylene 30% glass fiber), that may have a first end 12Mi fixedly secured to one side of the recess (e.g., the upper side), and a second end 12Mii that may be stretched to loop around a hook member 12H on the other side of the recess, to be releasably secured thereto, to thereby retain the arm bar 11 in the recess.

The pair of resistance members used for the multi-function exercise device 10 may be any member capable of opposing relative motion between the arm bar 11 and the leg bar 12, by resisting the rotation of the arms 17A/17B relative to the legs 12A/12B. In one embodiment, each of the resistance members may be a damper (see e.g., U.S. Pat. No. 7,861,376 to Fritz; and U.S. Pat. No. 7,748,082 to Harald), and where a rotary damper is used it may be at the pivotal connection between the arms 17A/17B and legs 12A/12B. In another embodiment, each of the resistance members may be a friction brake (see e.g., U.S. Pat. No. 4,907,677 to Yamashita). In yet another embodiment, each of the resistance members may be a spring, or may instead be the elastic bands 13 and 13A, as shown in FIG. 1. Merely to be exemplary, the resistance members are illustrated in the figures as elastic members, and the following discussion is presented solely with reference to the resistance members being described as "resistance bands" for the sake of convenience, with the understanding that other such mechanical arrangements and devices as noted above may be appropriately utilized, as well as any other equivalent devices/arrangements.

The resistance band 13 may have a first end secured to a first portion of the u-shaped member and a second end secured to a first portion of the arm 17A, while the resistance band 13A may have a first end secured to a second portion of the u-shaped member and a second end secured to a second portion of the arm 17B. In one embodiment, as shown in FIG. 1, the resistance band 13 may have a first end secured to the first leg 12A proximate to the transition between the first leg 12A and the leg bar 12, and the resistance band 13A may have a first end secured to the second leg 12B proximate to the transition between the second leg 12B and the leg bar 12. The bands 13 and 13A may be a cylindrical elastic member, the end of which may be fixedly secured within a bolt eye, with the shaft of the eye bolt being pivotally coupled to the respective arm and/or leg. Depending upon the type of exercise and the portion of that exercise being performed, the bands 13 and 13A may serve to provide resistance to the muscles being exercised, or alternatively may provide assistance to those muscles, as discussed hereinafter.

Figure 2:
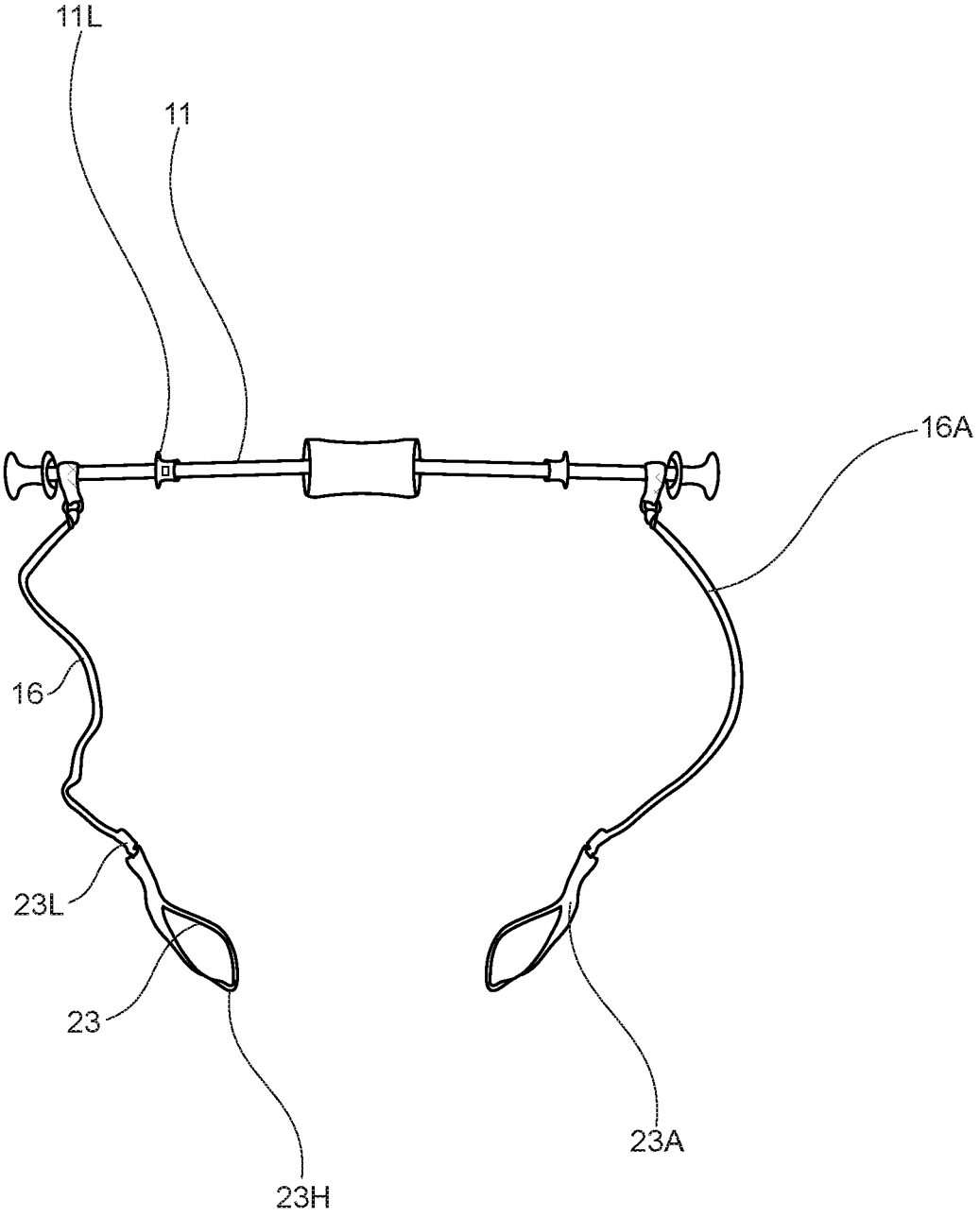
FIG. 2 is a top view of the arm bar of the multi-function exercise device of FIG. 1, with the telescoping bars shown after being extended outwardly from the main bar, and with the respective resistance bands unrolled from the telescoping bars.

The multi-function exercise device 10 may also include a second pair of resistance bands, where a first resistance band 16 of the second pair of resistance bands has a first end secured to a first portion of the arm bar 11 (e.g., proximate to a first end of the arm bar), and a second resistance band 16A of the second pair of resistance bands may have a first end secured in proximity to a second end of the arm bar. Each of the seconds ends of the resistance bands 16 and 16A may have a respective foot loop 23/23A secured thereto, as seen in FIG. 2. The foot loops 23/23A may be formed of any suitable material, including, but not limited to, a strip of nylon material. The resistance bands 16 and 16A may be rolled onto the arm bar 11 to be stored thereat when not in use, as shown in FIG. 1. To releasably secure the resistance bands 16 and 16A in the rolled condition, each loop 23/23A may be formed with a hook material and a loop material, which are descriptive names for such materials sold under the trademark VELCRO®, so that each loop can also act as a securement strap. In one embodiment, both the hook and loop materials may be part of each foot loop 23/23A (see the hook material 23H and the loop material 23L shown on foot loop 23A in FIG. 2). In another embodiment, one of the hook and loop materials may be part of each loop 23/23A, (e.g., the hook material 23H on the foot loop 23A) and the other of those two materials may be attached to an adjacent location on the arm bar 11. (e.g., the loop material 11L shown on the arm bar in FIG. 2). In another embodiment, rather than using hook and loop materials, a clip, or male and female snap members (see e.g., U.S. Pat. No. 2,042,866 to Simmons) may be used to releasably secure the loops 23/23A and the resistance bands 16 and 16A in the rolled condition.

Additionally or alternatively, to better keep the resistance bands 16 and 16A from sliding laterally while in the rolled condition, respective reels 11Ri and 11Rii may be used on the arm bar 11, and the bands may be wound within the bounds of the reel, and those bands may also still be secured using the hook and loop materials. In one embodiment, the reels may each be a separate part that may be secured onto the bar, which reel may resemble a fishing reel or a spool upon which thread is typically wound and stored. In another embodiment each reel may consist of only a pair of annular flanges being integrally formed as part of the arm bar 11.

The multi-function exercise device 10 being so configured may be used for over 30 different exercises, to enable a user to complete a total body workout.

Figure 26A:
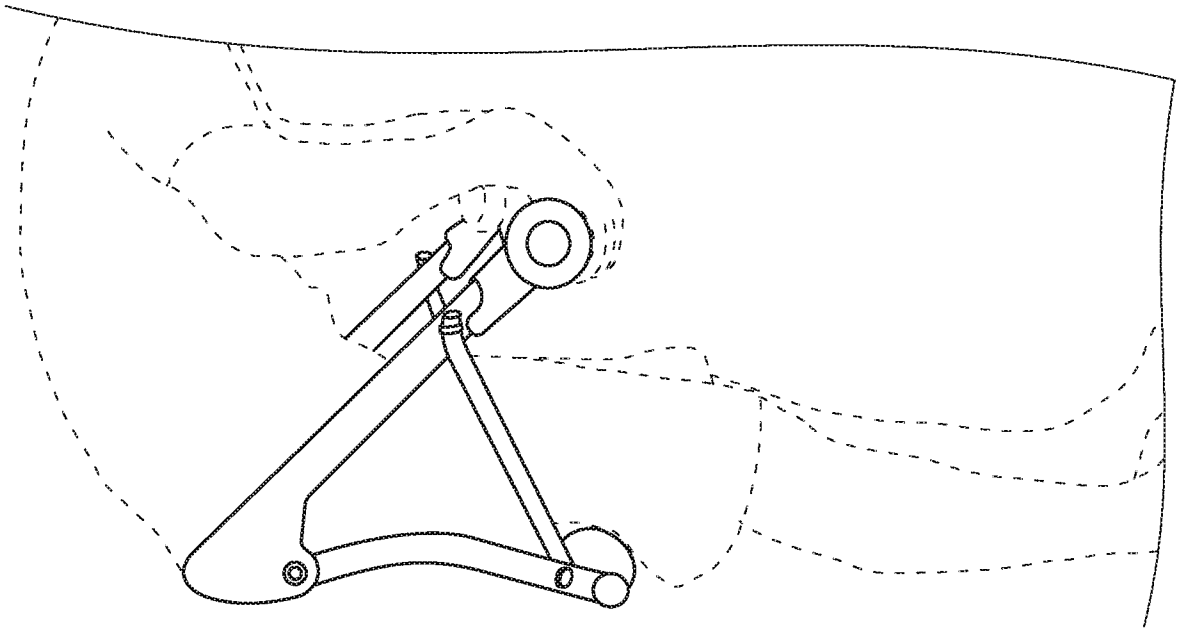
FIG. 26A is the multi-function exercise device of FIG. 1, but shown after a user initially places his/her legs between the arm bar and leg bar and positions the legs on top of the leg bar, and subsequently grasps the arm bar with his/her hands.
Figure 26B:
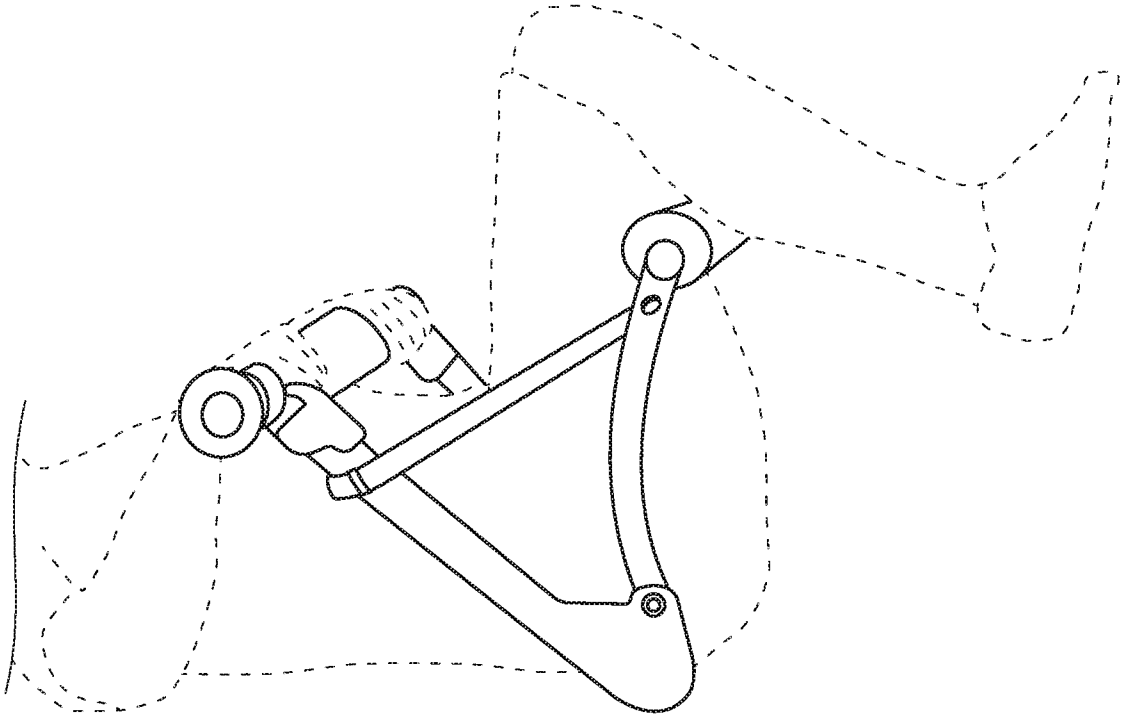
FIG. 26B shows the user engaged multi-function exercise device of FIG. 26A, but is shown after the user has rolled backwardly to place his-her back on the ground, and raise his/her legs in preparation for performing abdominal exercises.
Figure 26C:
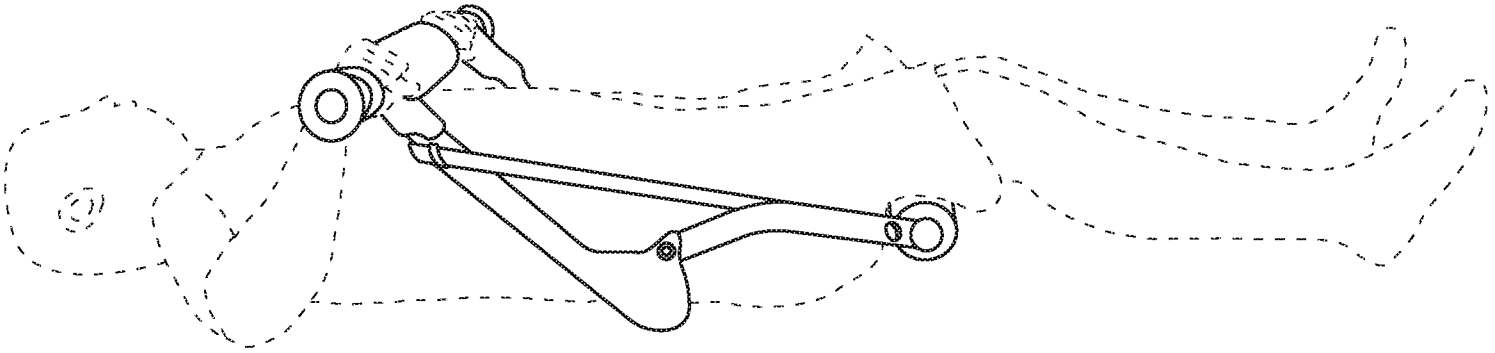
FIG. 26C shows the user engaged multi-function exercise device of FIG. 26B, but is shown after the user has utilized his core muscles to drive his/her legs against the resistance provided by the resistance bands attached to the leg bar, to perform abdominal exercises such as leg pull-ins in which the knees are bent, leg lifts in which the legs remain generally straight, etc.
Figure 27A:
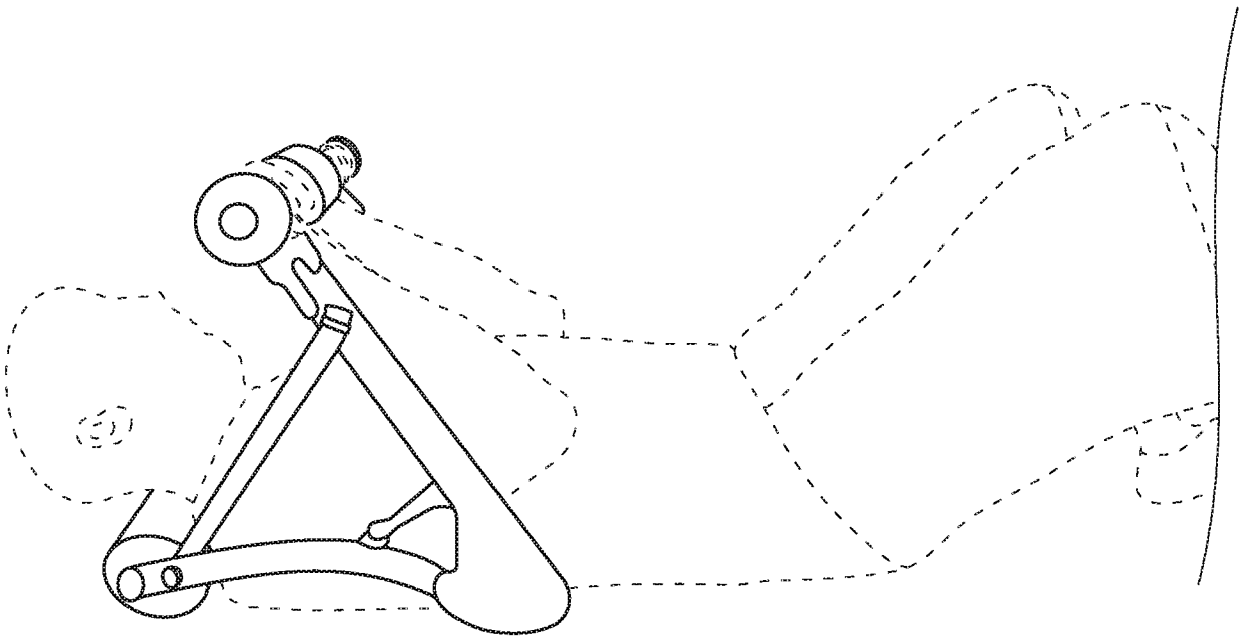
FIG. 27A is the multi-function exercise device of FIG. 1, shown after the first and second arms are latched with respect to the corresponding arms, and after a user initially places his/her head and shoulders between the arm bar and leg bar, positions his/her neck on top of the leg bar, and grasps the arm bar with his/her hands in preparation for doing ab crunches.
Figure 27B:
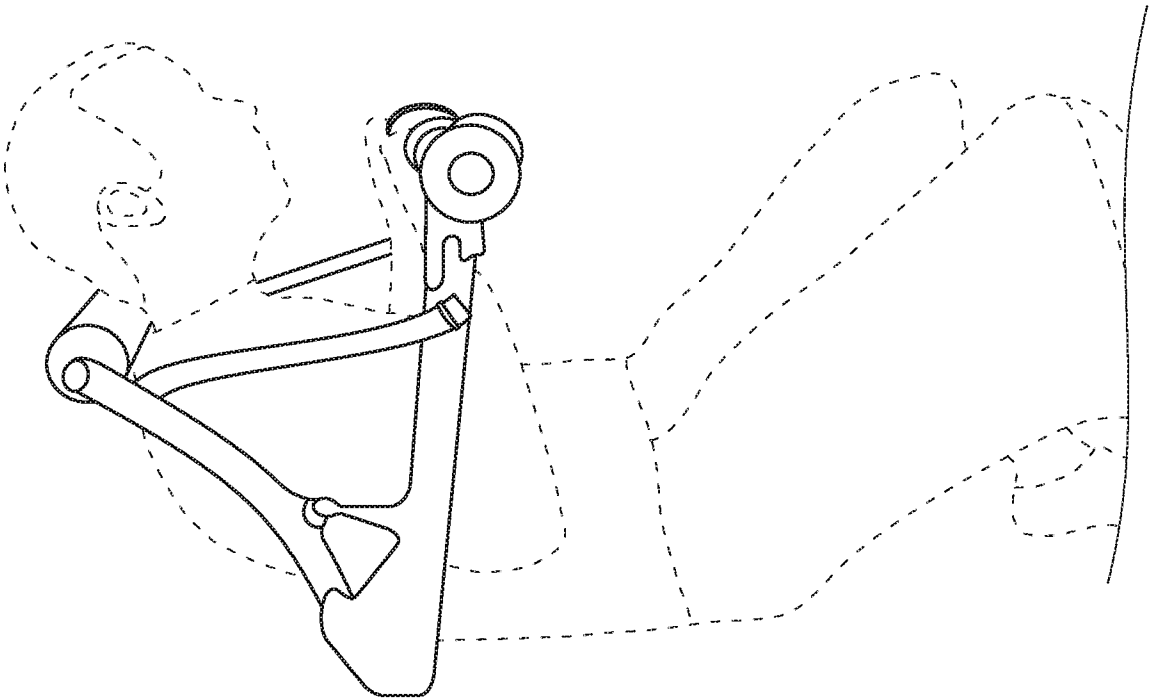
FIG. 27B shows the user engaged multi-function exercise device of FIG. 27A, but is shown after the user has utilized his/her core muscles to elevate his head and shoulder during an ab crunch.
Figure 28A:
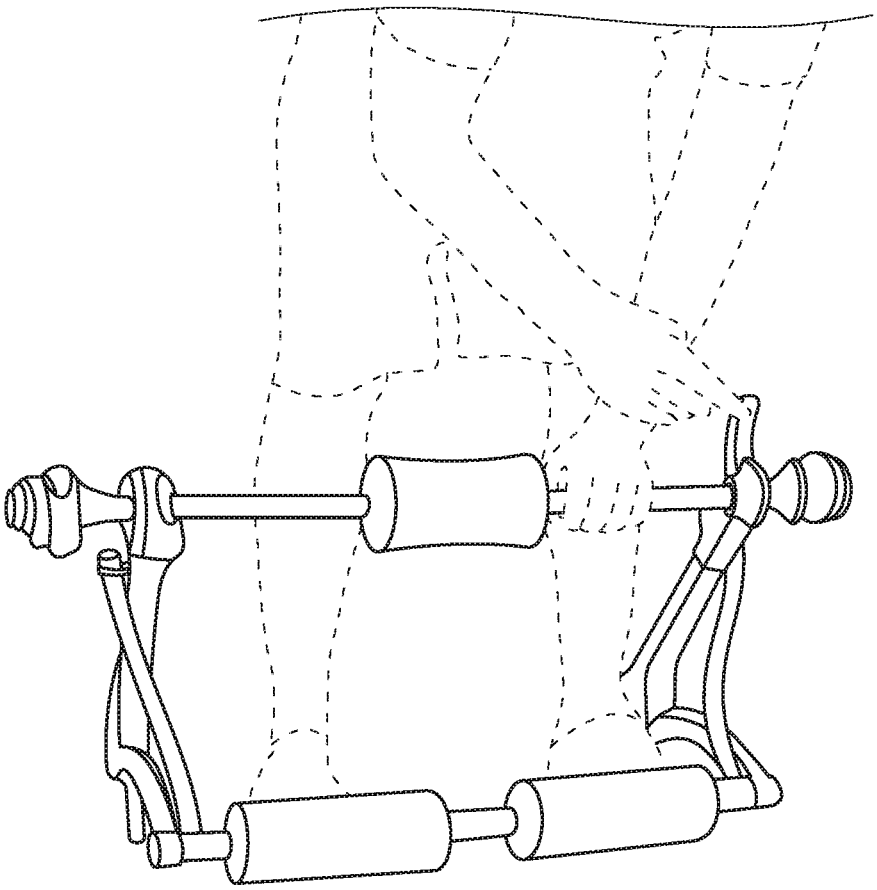
FIG. 28A is a perspective view showing a user toggling one of the latches that releasably secures the arm bar to the arms of the frame.
Figure 28B:
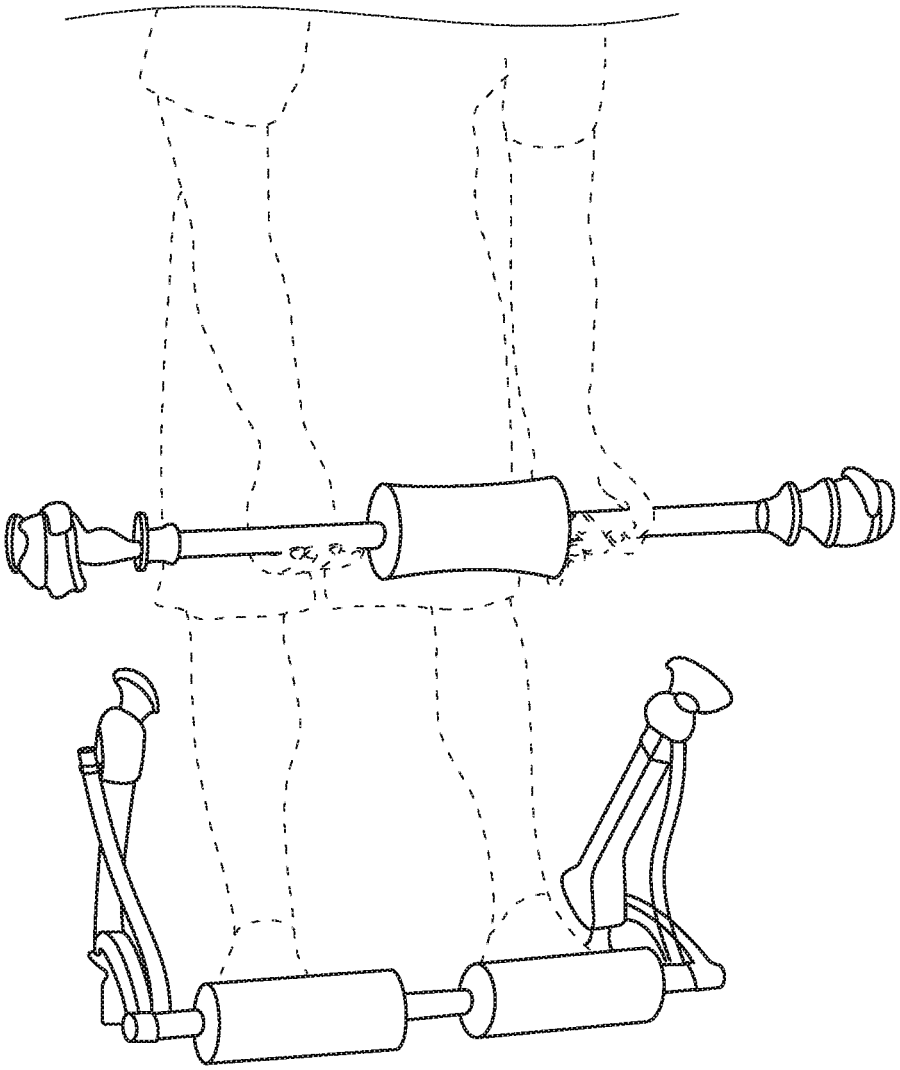
FIG. 28B is the perspective view of FIG. 28A, but shown after the user has toggled both latches and has separated the arm bar from the arms of the frame.
Figure 29:
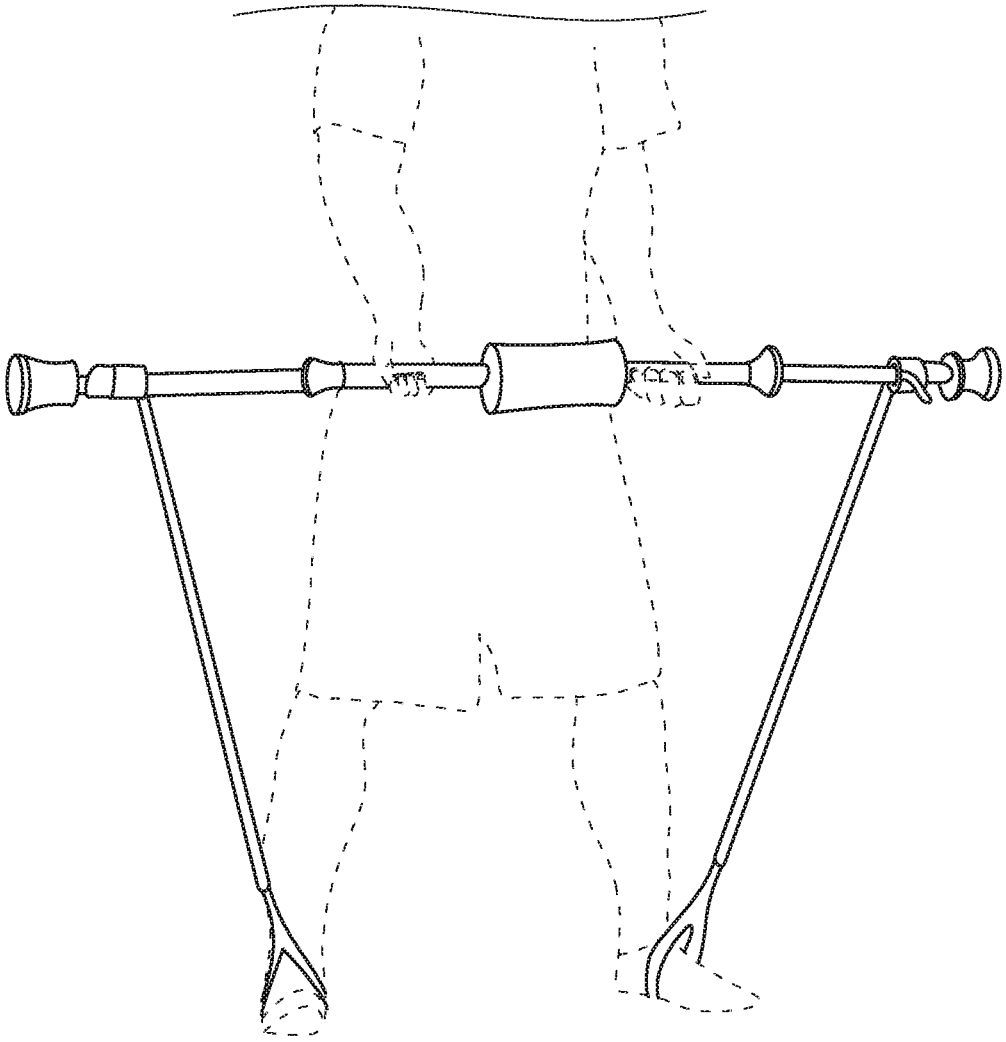
FIG. 29 is a perspective view showing the separated arm bar of FIG. 28A, but shown after the user has released the resistance bands at each end of the arm bar and has placed the foot loops at the ends of the resistance bands placed on the left and right feet in preparation for doing curls using the arm bar.

With the multi-function exercise device 10 being configured as shown in FIG. 1, i.e., with the arm bar 11 releasably secured to the arms 17A/17B, it may be used for a first plurality of exercises; e.g., abdominal exercises such as the leg pull-ins shown in FIGS. 26A-26C in which the knees are bent, the leg lifts shown in FIGS. 27A-27B, in which the legs remain generally straight, etc.).

Figure 22:
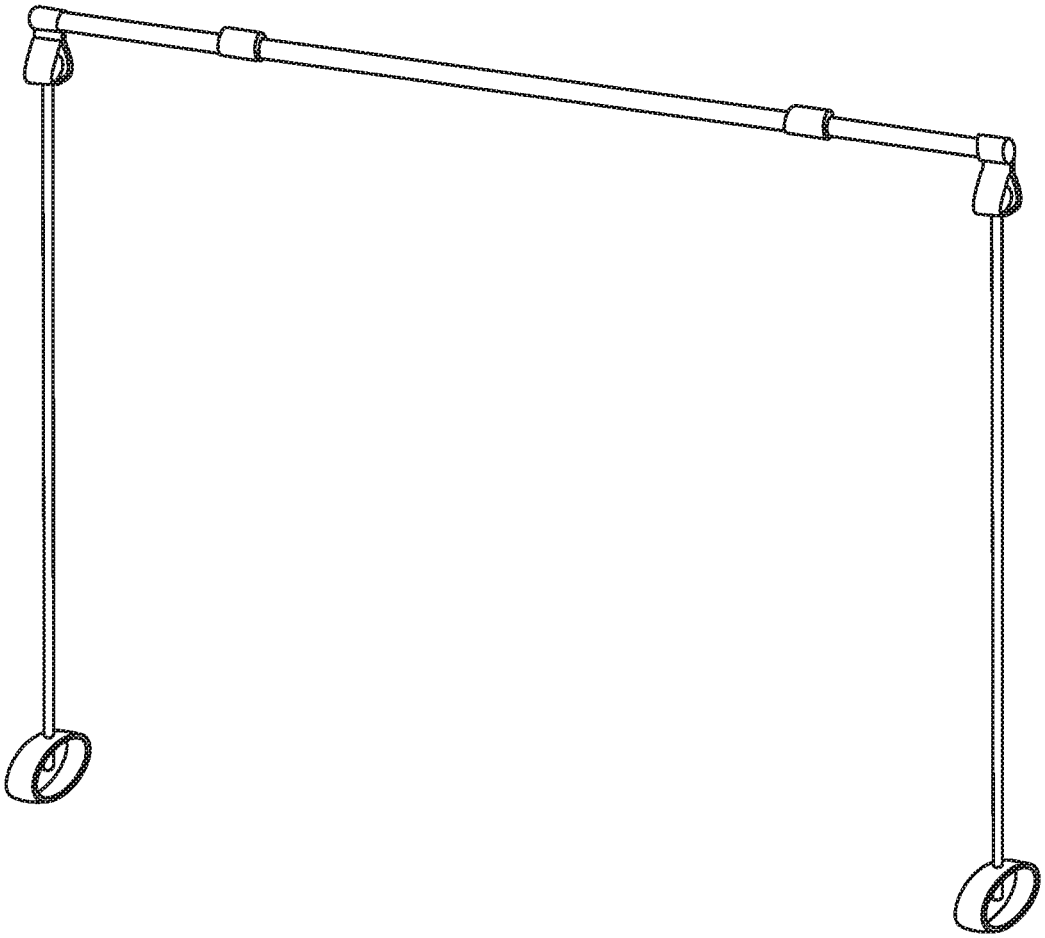
FIG. 22 is a perspective view of the arm bar, with the resistance bands at the ends of the arm bar after being released and allowed to hang downwardly.
Figure 23A:
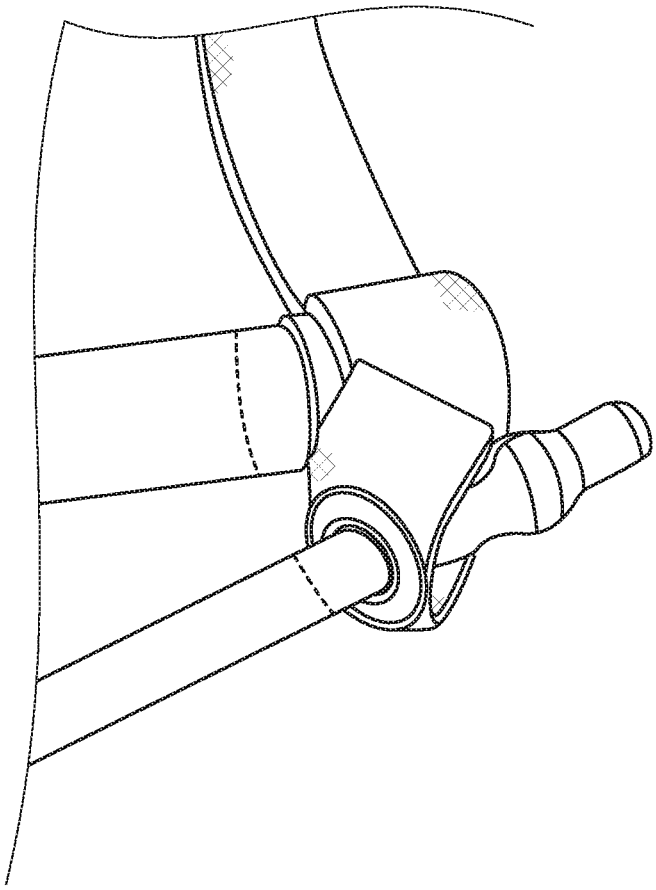
FIG. 23A is a first perspective view of a connector that may be used to couple the resistance bands to the ends of the arm bar.
Figure 23B:
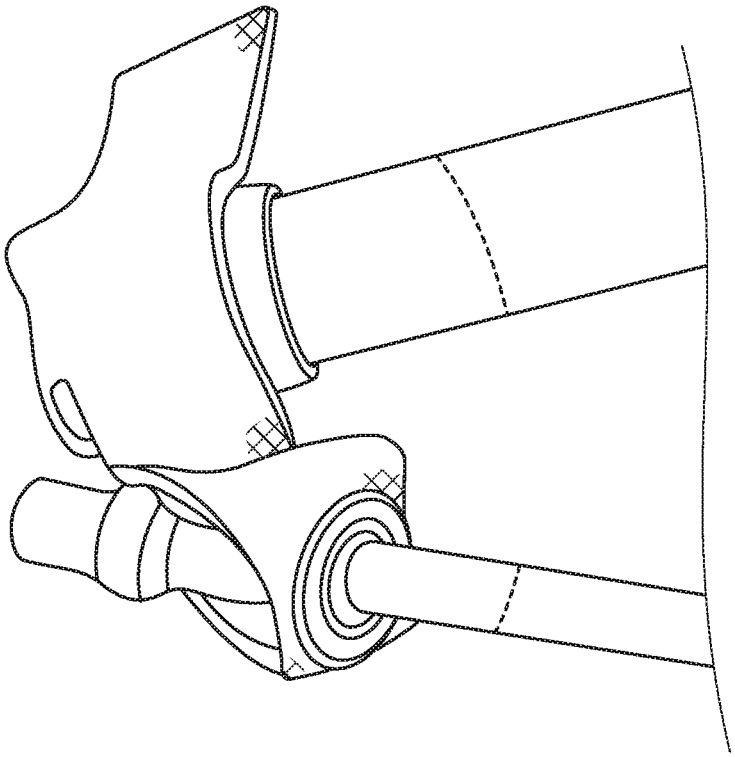
FIG. 23B is a second perspective view of the connector of FIG. 23A that may be used to couple the resistance bands to the ends of the arm bar.
Figure 24A:
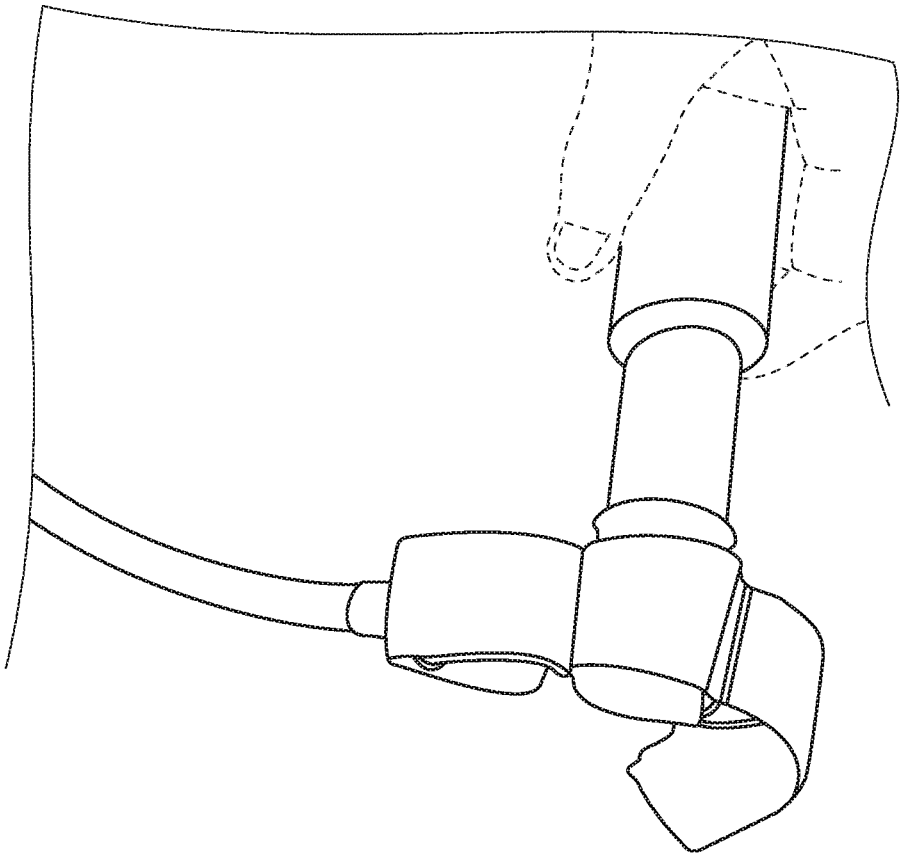
FIG. 24A is a third perspective view of the connector of FIG. 23A that may be used to couple the resistance bands to the ends of the arm bar.
Figure 24B:
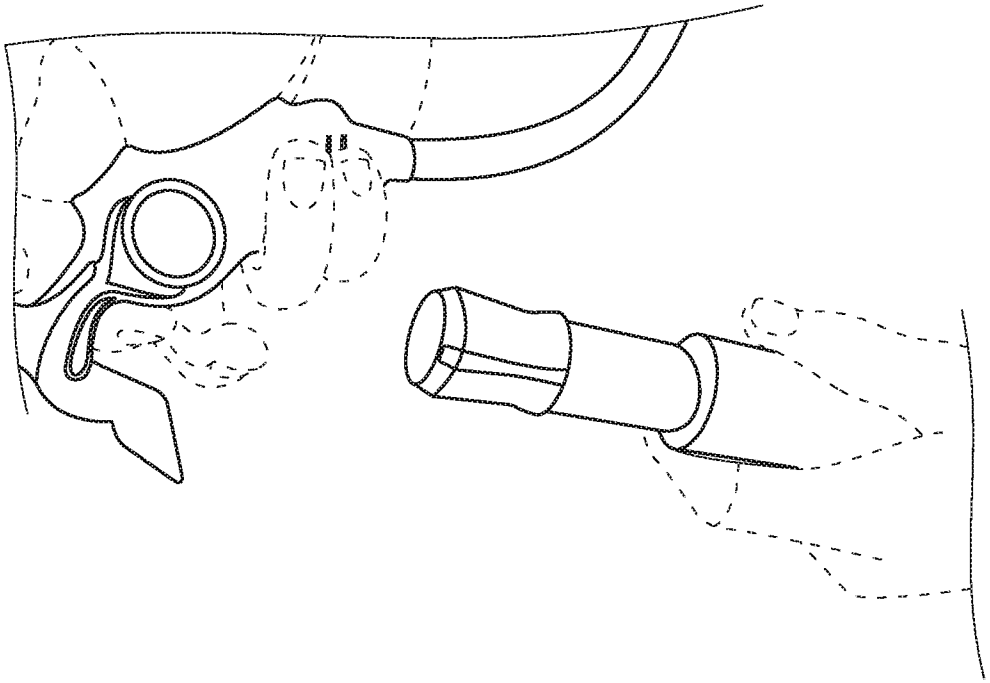
FIG. 24B is the perspective view of FIG. 24A, but shown with a portion of the connector uncoupled from the arm bar.
Figure 25:
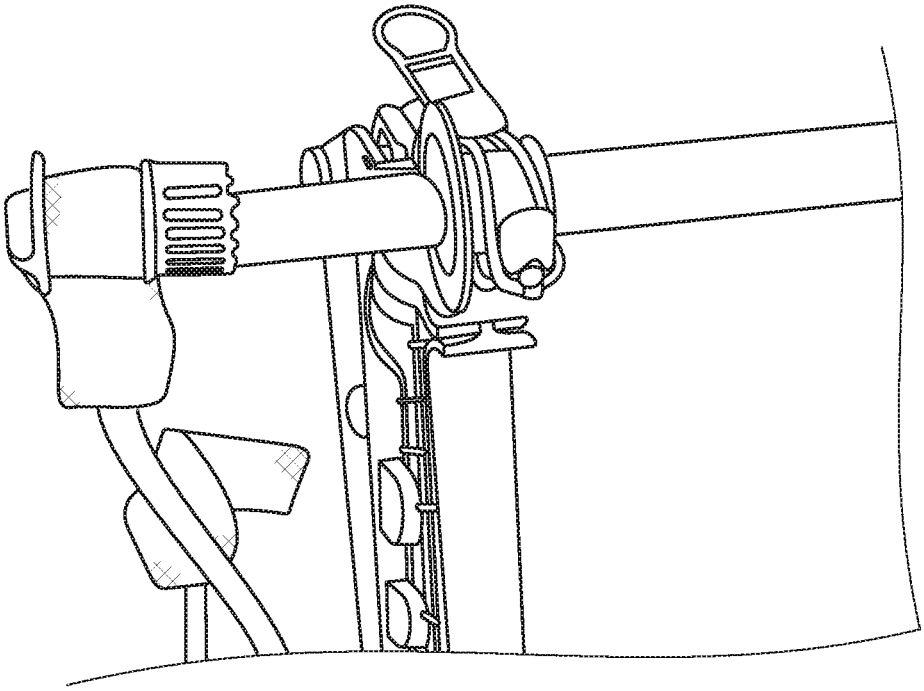
FIG. 25 is a fourth perspective view showing another connector that may be used to couple the resistance bands to the ends of the arm bar.

With the arm bar 11 detached from the arms 17A/17B and with the resistance bands 16 and 16A hanging down therefrom, as shown in FIG. 2 and FIG. 22, the arm bar may be utilized for a second plurality of exercises; e.g., the exercises shown in FIGS. 29-38, etc.). The resistance bands 16 and 16A may be unwound completely or partially and may be rewound appropriate amounts to hang down only a particular amount that may be suitable for the height of the person currently using the device, and/or being suitable for the particular exercise currently being performed.

Figure 30:
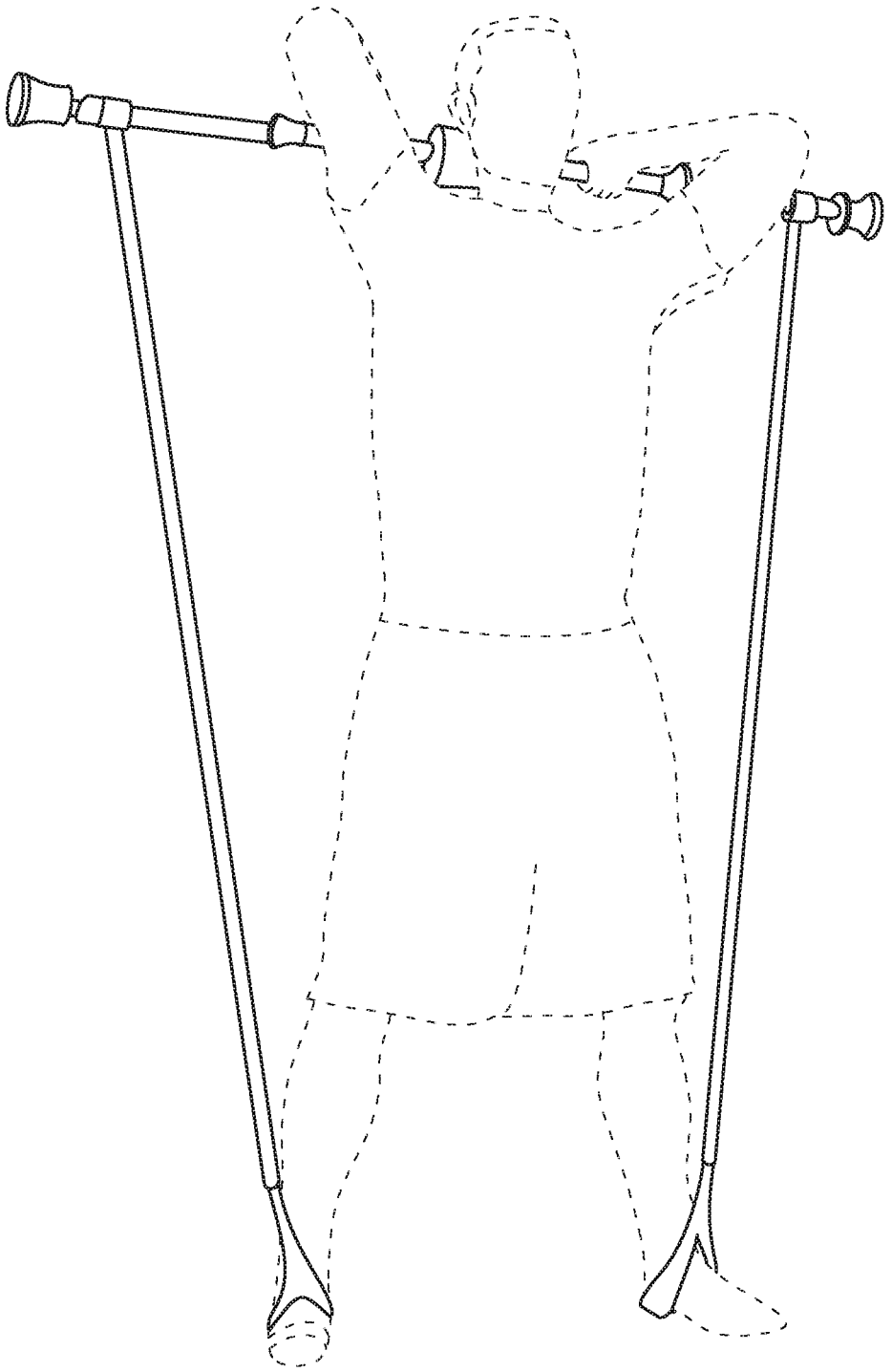
FIG. 30 is a perspective view showing the separated arm bar, with the foot loops at the ends of the resistance bands placed on the left and right feet, but with the arm bar being held positioned behind the user's head just prior to doing overhead arm rotations to isolate and exercise the triceps.
Figure 31:
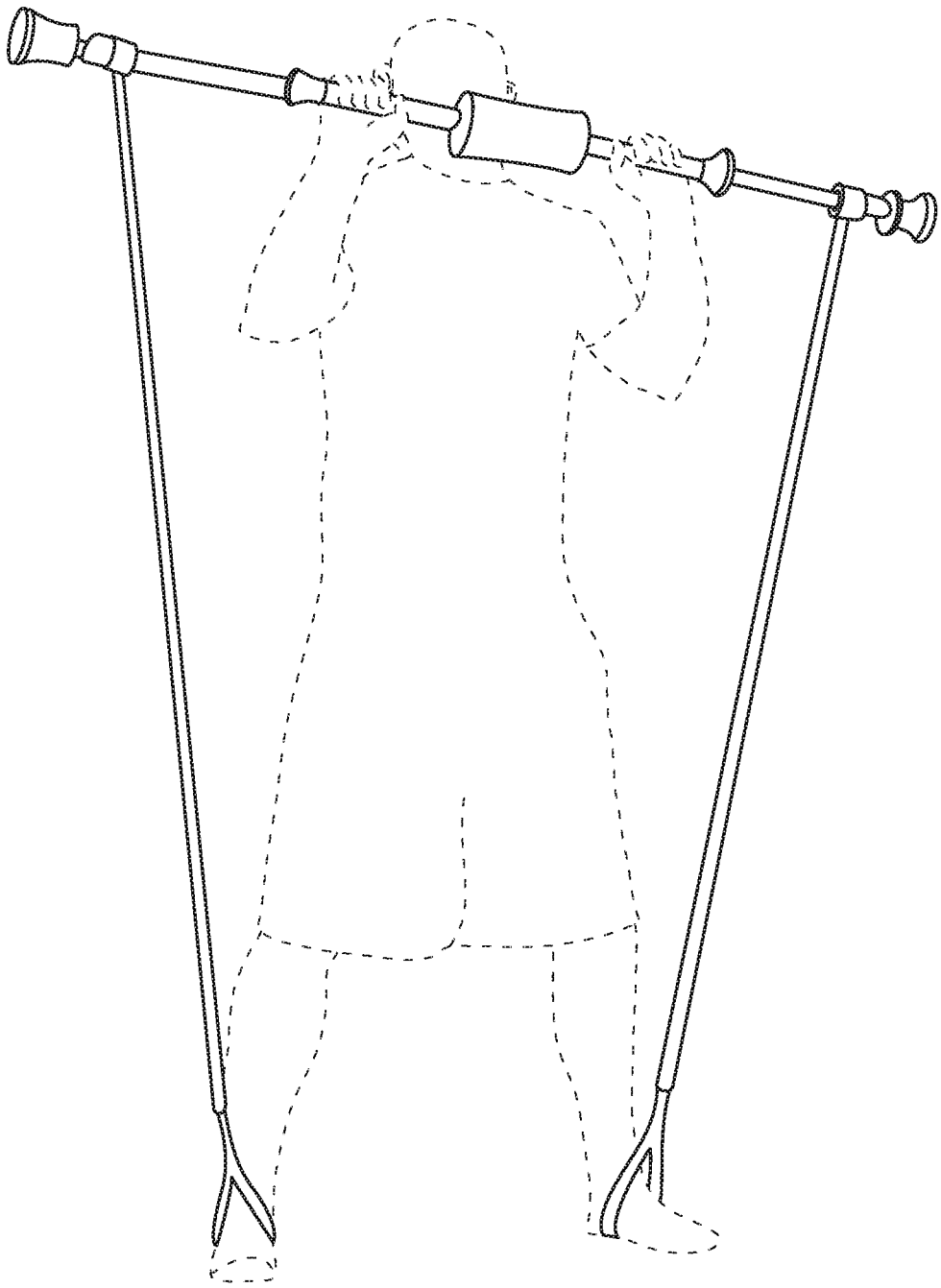
FIG. 31 is a perspective view showing the separated arm bar, with the foot loops at the ends of the resistance bands placed on the left and right feet, but with the arm bar being held positioned at the user's chest just prior to doing overhead press exercises.
Figure 32:
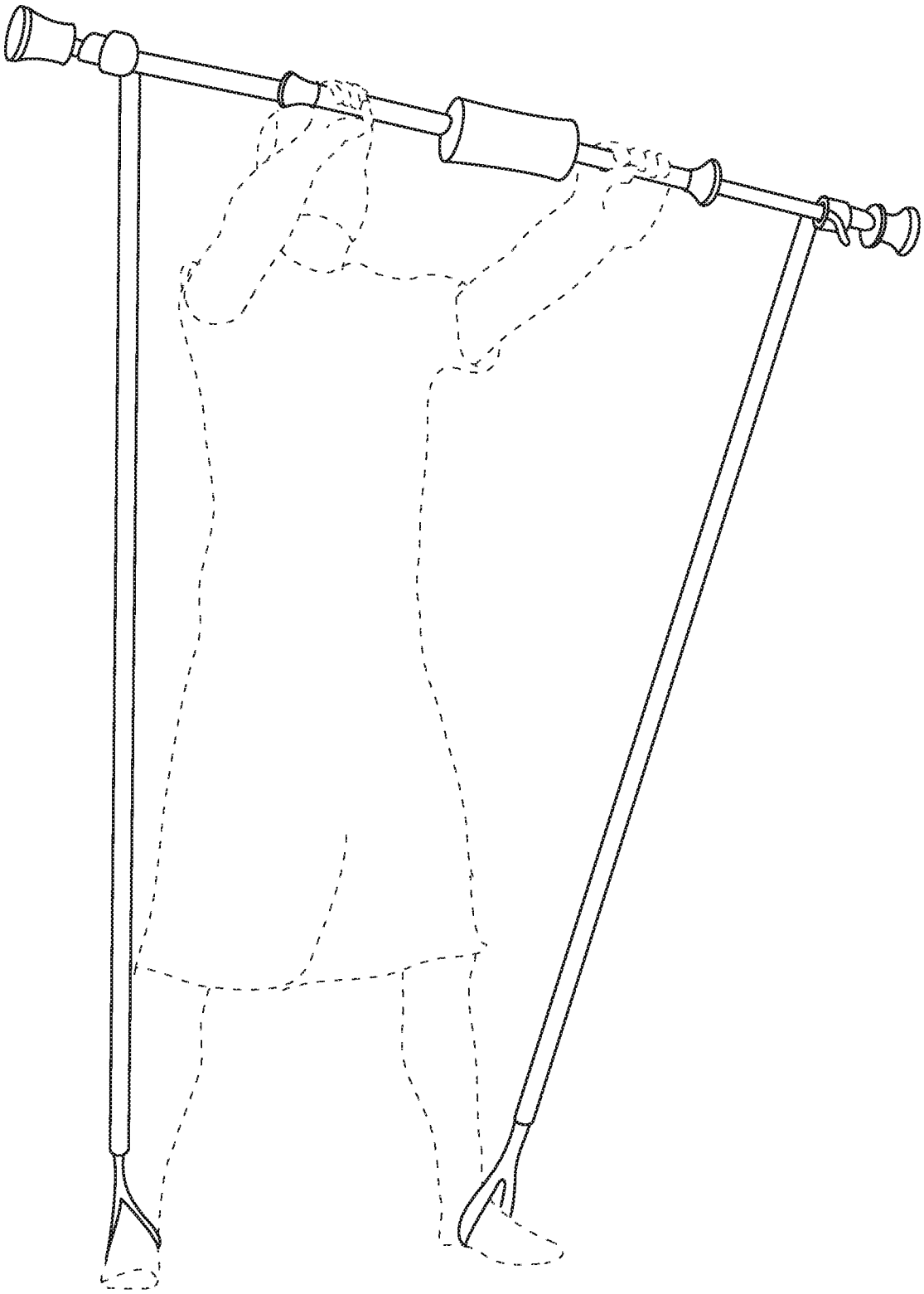
FIG. 32 is a perspective view showing the separated arm bar, with the foot loops at the ends of the resistance bands placed on the left and right feet, but with the arm bar being held with straight arms positioned forwardly above the user's waist while doing arm raise/extension exercises.
Figure 33:
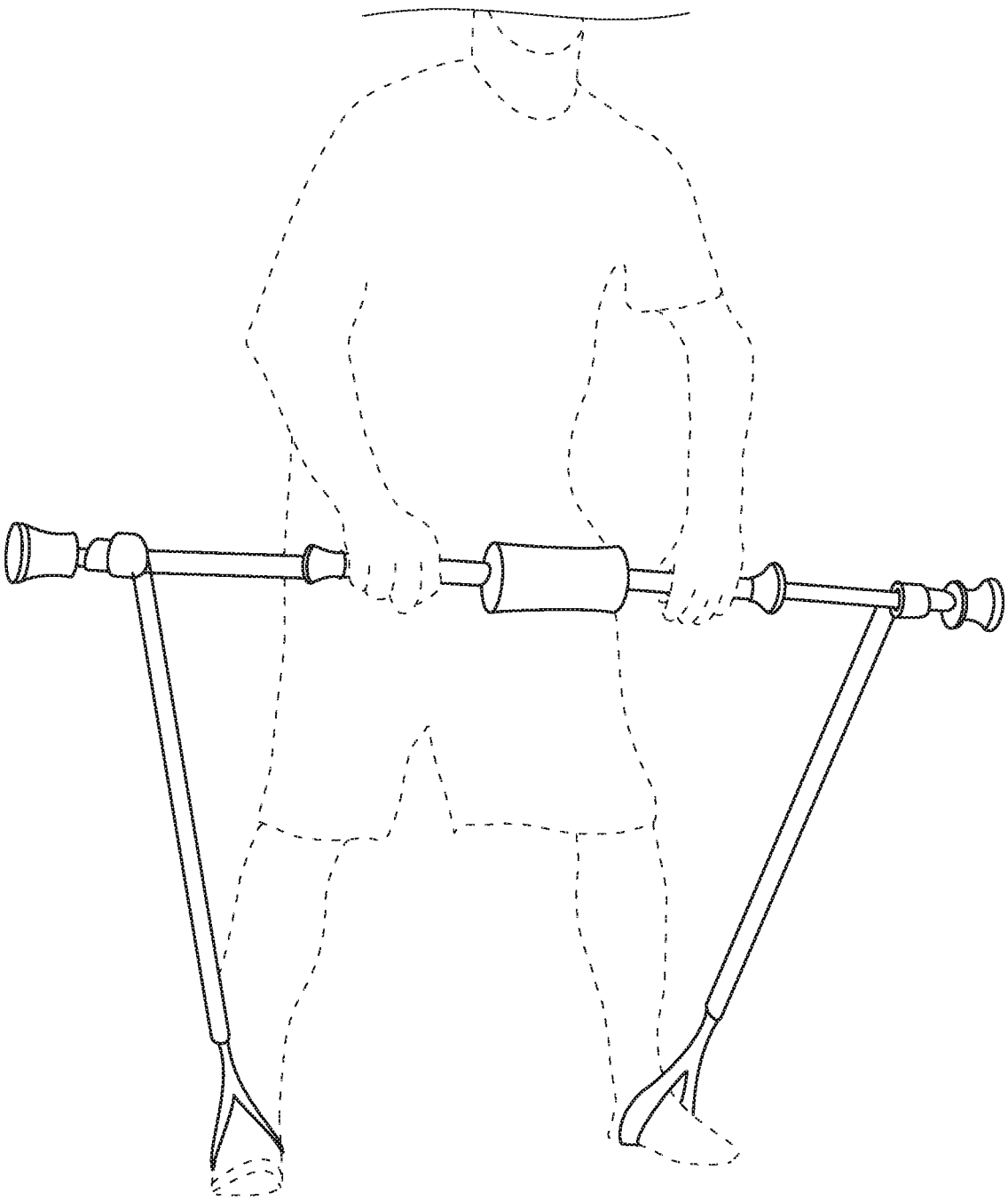
FIG. 33 is a perspective view showing the separated arm, with the foot loops at the ends of the resistance bands placed on the left and right feet, but with the arm bar being held positioned at the user's waist just prior to doing arm lift exercises.
Figure 34:
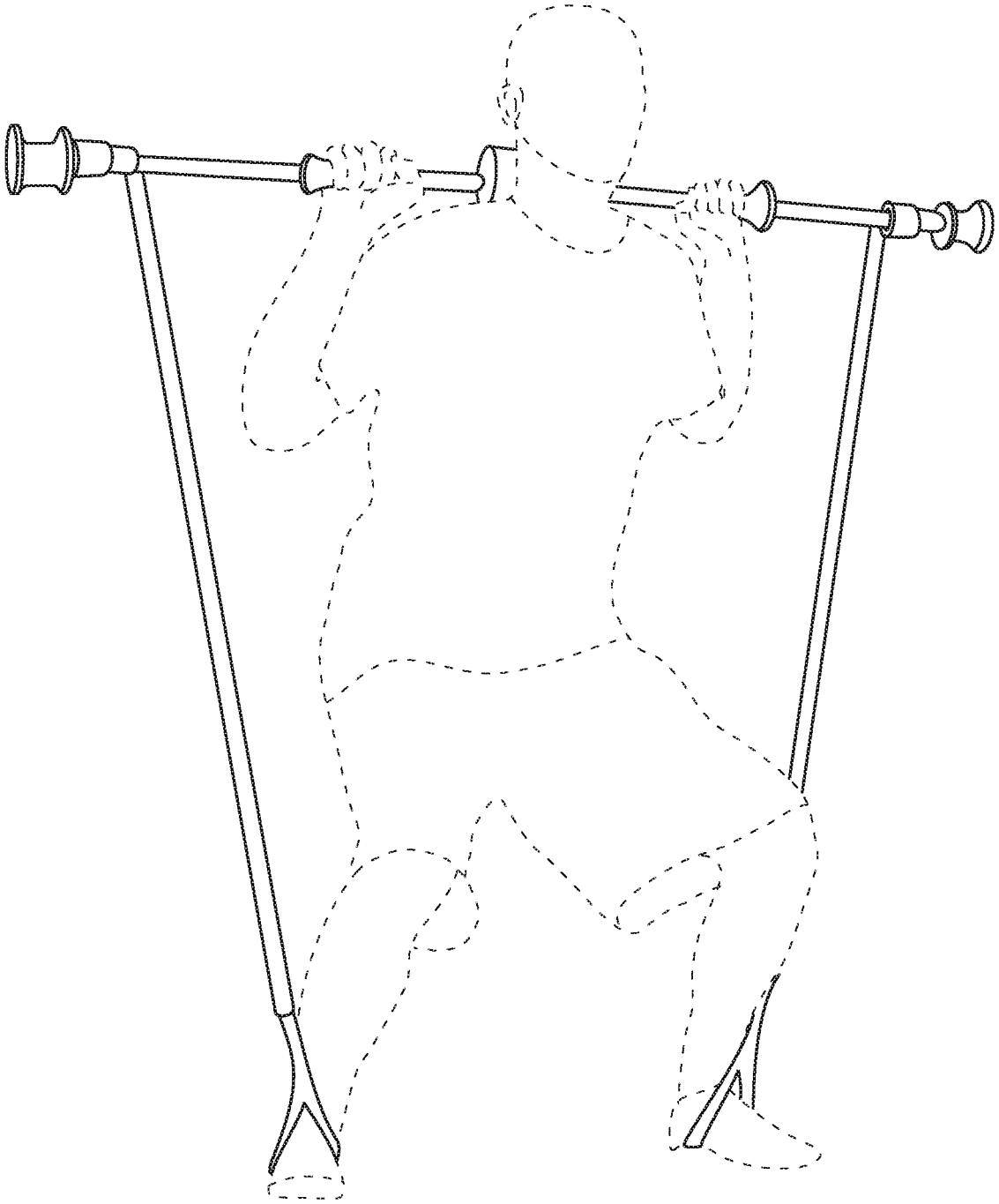
FIG. 34 is a perspective view showing the separated arm bar, with the foot loops at the ends of the resistance bands placed on the left and right feet, but with the arm bar being held positioned behind the user's head resting on the shoulders, while doing squat exercises.
Figure 35:
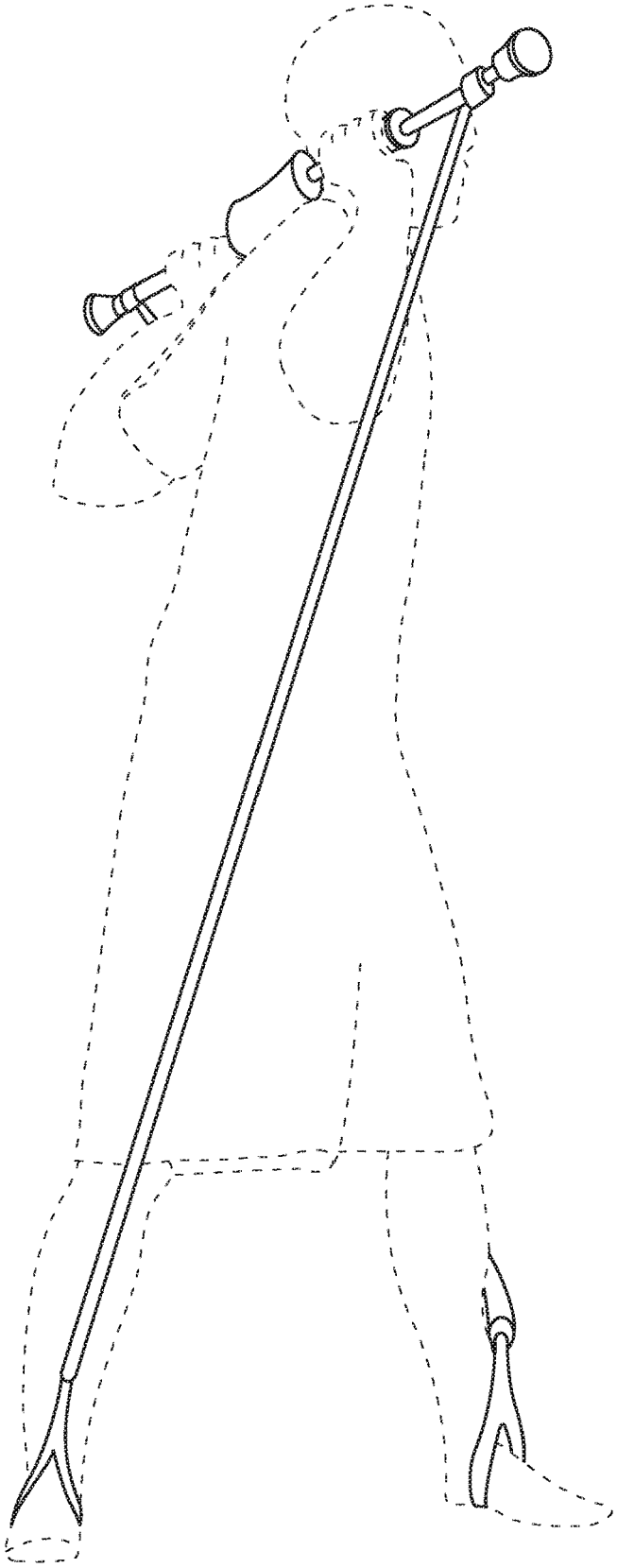
FIG. 35 is a perspective view showing the separated arm bar, with the foot loops at the ends of the resistance bands placed on the left and right feet, but with the arm bar being held positioned behind the user's head resting on the shoulders, while doing trunk rotation exercises.
Figure 36:
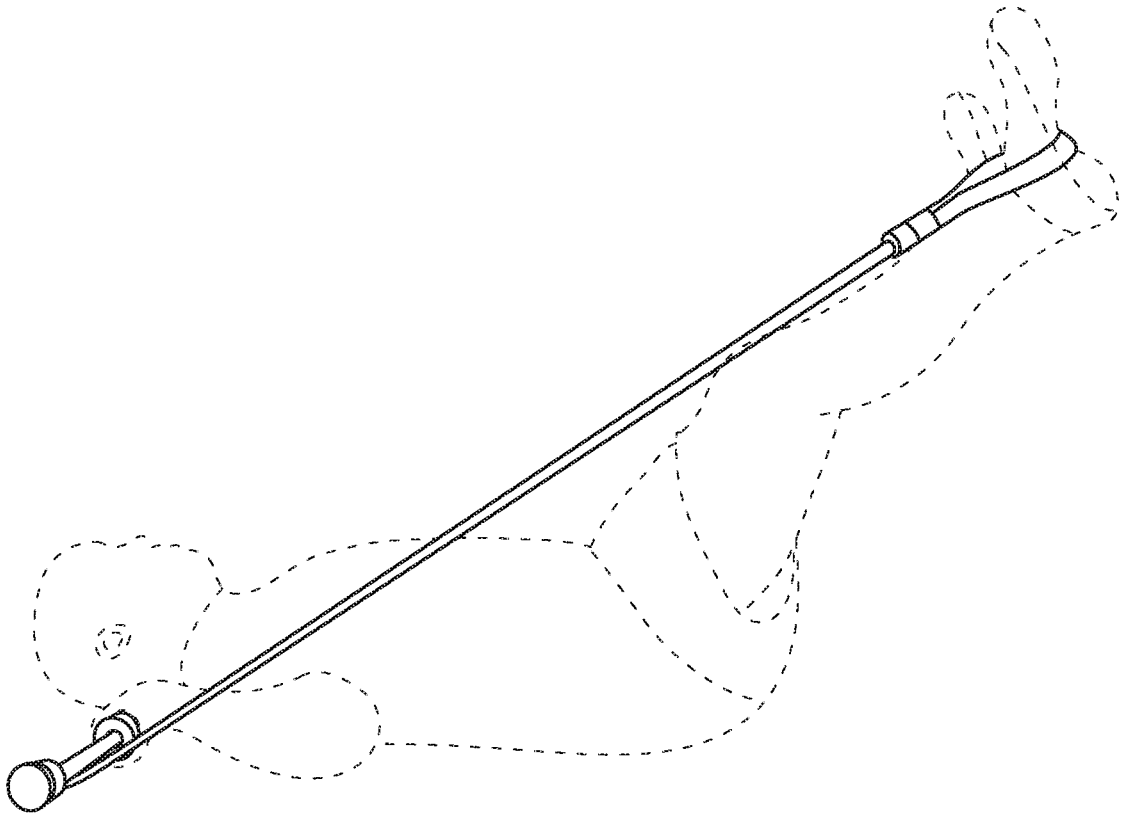
FIG. 36 is a perspective view showing the separated arm bar, with the foot loops at the ends of the resistance bands placed on the left and right feet, but with the user lying with his/her back on the ground and legs lifted just off the ground and held together, while doing leg separation exercises.
Figure 37:
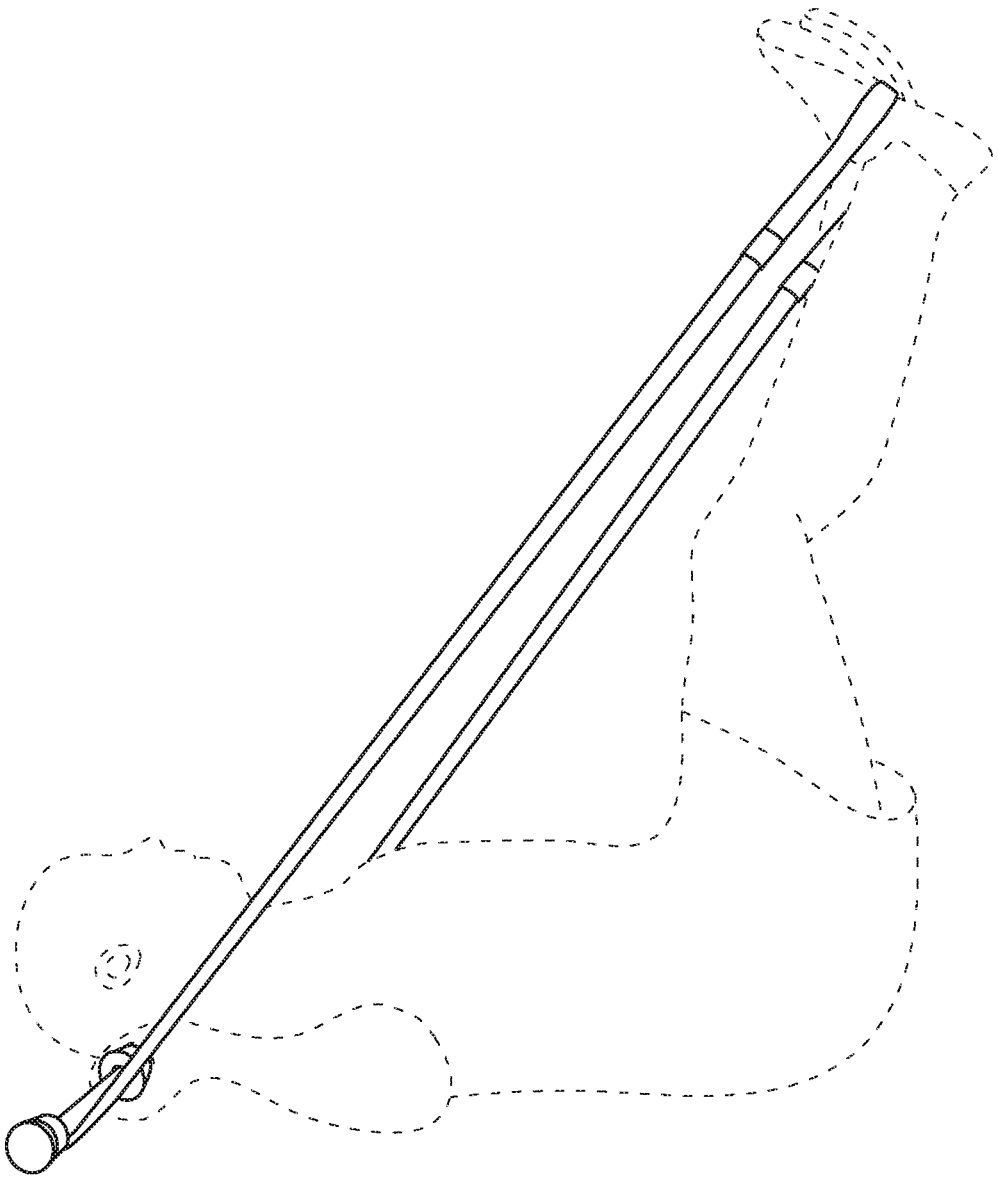
FIG. 37 is a perspective view showing the separated arm bar, with the foot loops at the ends of the resistance bands placed on the left and right feet, but with the user lying with his/her back on the ground and legs lifted off the ground, while doing leg raise exercises.
Figure 38:
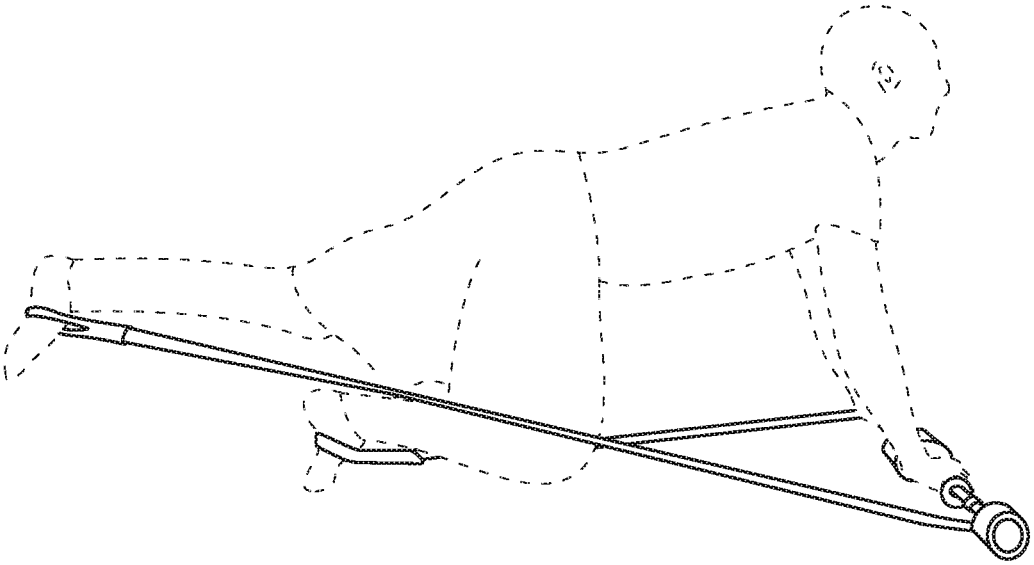
FIG. 38 is a perspective view showing the separated arm bar, with the foot loops at the ends of the resistance bands placed on the left and right feet, but with the user positioned on the ground in a crawling position with one leg lifted just off the ground, just prior to doing leg extension exercises.

In another embodiment, the multi-function exercise device 10 may also include a first telescoping bar 15 and a second telescoping bar 15A that may respectively telescope outwardly from within the hollow arm bar 11, as shown in FIG. 1, so that the resistance bands 16 and 16A may be positioned farther away from the user's body during certain exercises (see e.g., FIG. 30). The first telescoping bar 15 and second telescoping bar 15A may each be retained at the extended position (and also the retracted position) by a detent arrangement, e.g., a spring biased ball that may be biased to protrude out of an opening (e.g., opening 11P) in the arm bar 11 (see FIG. 1). In a different embodiment, the multi-function exercise device 10 may utilize a non-telescoping three piece bar.

Figure 4:
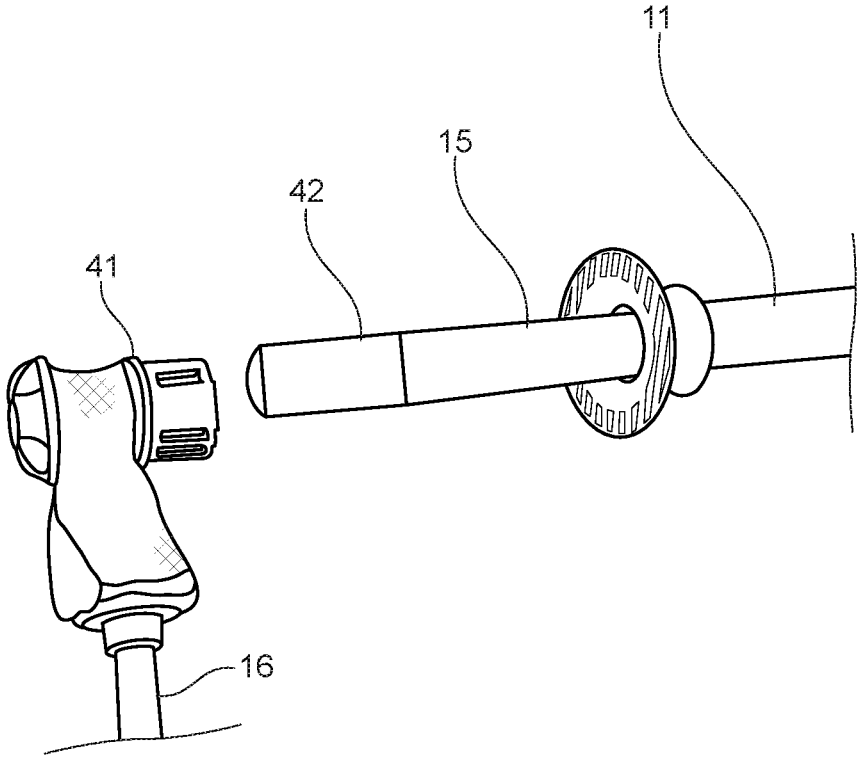
FIG. 4 is a portion of the top view of FIG. 2 shown enlarged, and also shown after the male connector, which supports the resistance band and foot loop, is uncoupled from the female connector on the telescoping bar.

In yet another embodiment, as shown in FIG. 4, the multi-function exercise device 10 may be formed to include a quick disconnect arrangement to releasably couple each resistance band 16/16A to the arm bar 11 and/or telescoping bar 15/15A, which coupling arrangement may include, but is not limited to, the male coupler 41 and the female couple 42 shown in FIG. 4. The quick disconnect arrangement permits the resistance bands 16/16A to easily and quickly snap on and/or off, to permit changing of the resistance band to one of greater or lesser resilience (resistance), to accommodate different users, or to accommodate the same user that may need/use a different resistance level for various different exercises, or as progress is made during strength training.

Figure 5:
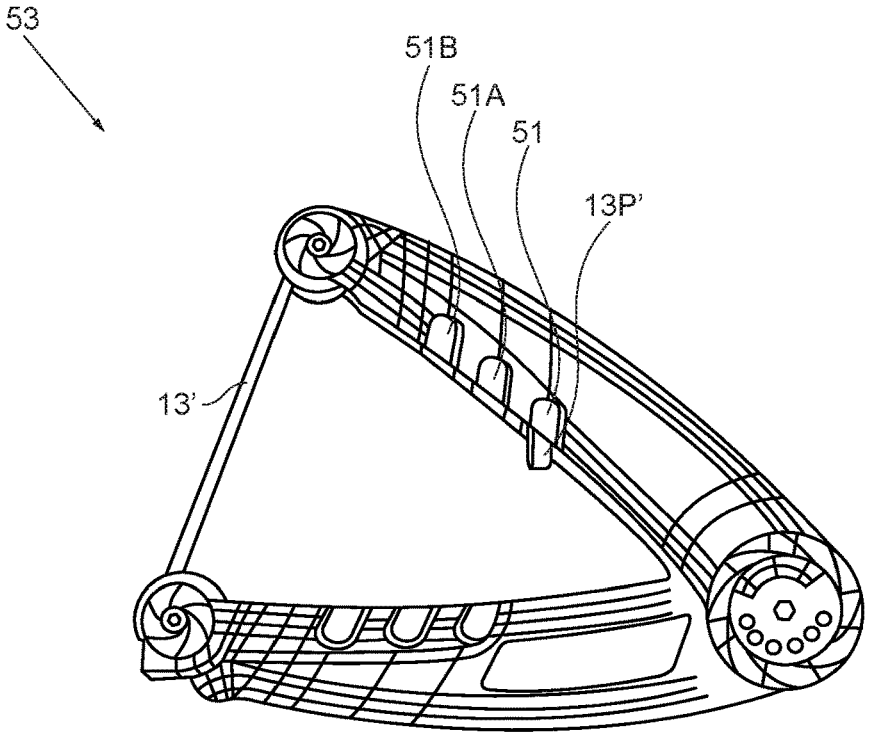
FIG. 5 shows an alternate embodiment for the first and second legs of the frame and for the corresponding arm of the device of FIG. 1, permitting adjustments as configured to the securement location of one end of the resistance band to change the amount of resistance provided by the band.
Figure 6:
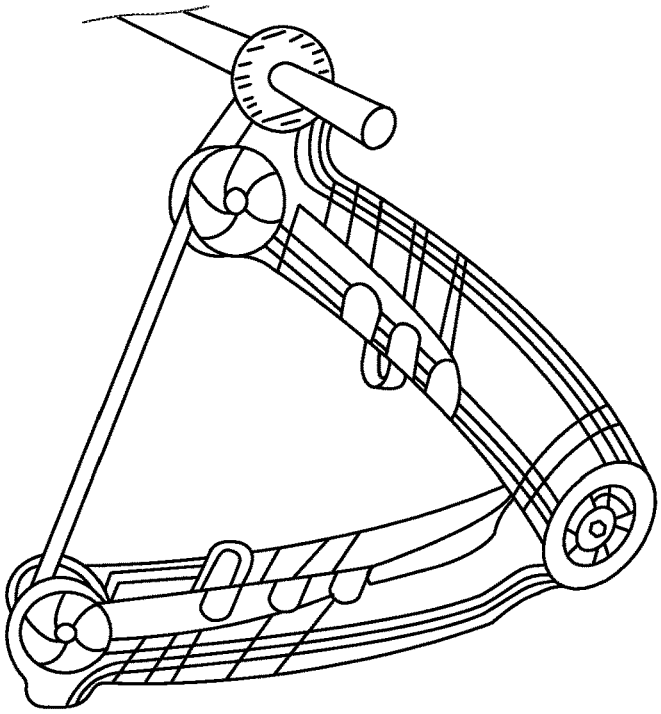
FIG. 6 shows other alternate embodiments that may be used for the first and second legs of the frame and the corresponding arm for the device of FIG. 1, permitting adjustments to the securement location for both ends of the resistance band to change the amount of resistance provided by the band.
Figure 7:
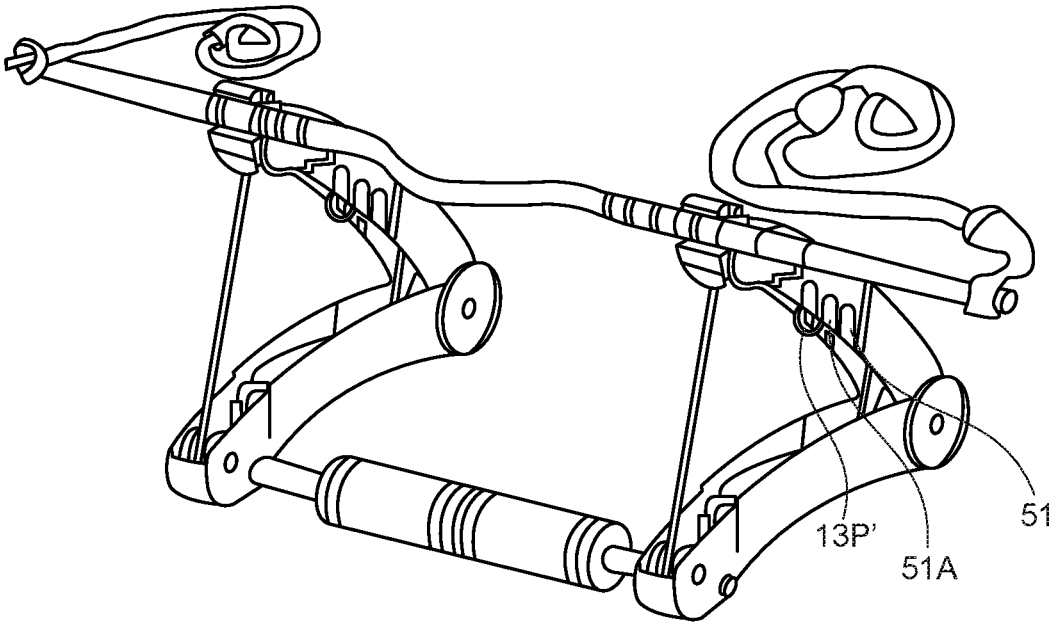
FIG. 7 is a perspective view of a second embodiment of a multi-function exercise device, formed similar to the embodiment of FIG. 1, but uses one of the leg embodiments of FIGS. 5-6, and has an arm bar with a central curved portion to contour around the user's head when used thereat.
Figure 8:
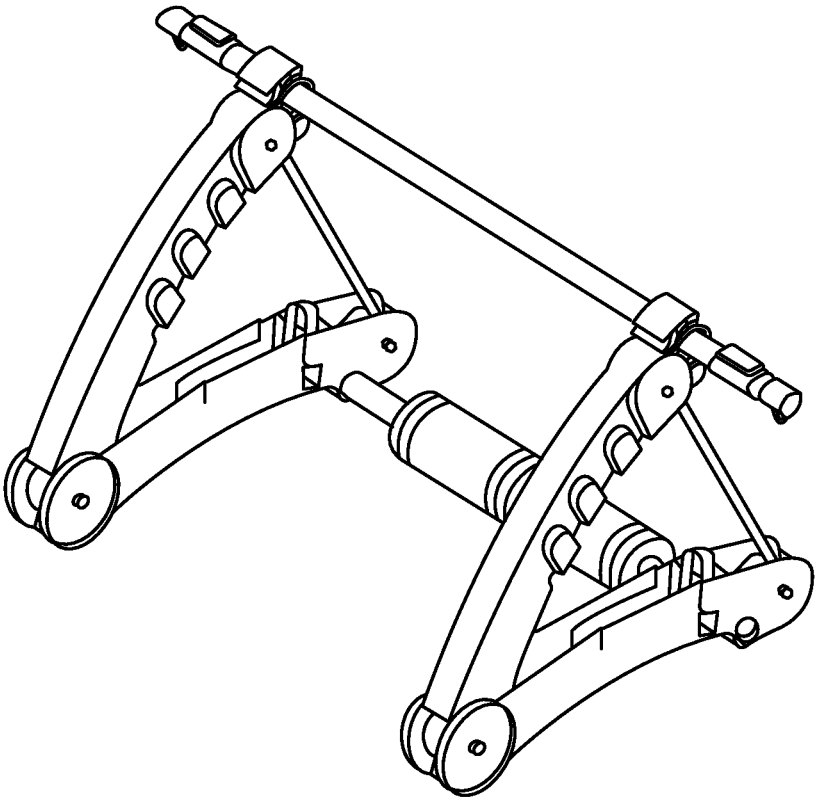
FIG. 8 is a perspective view of a second embodiment of a multi-function exercise device, formed similar to the embodiment of FIG. 7, and which uses different resistance bands for the arm bar.
Figure 9:
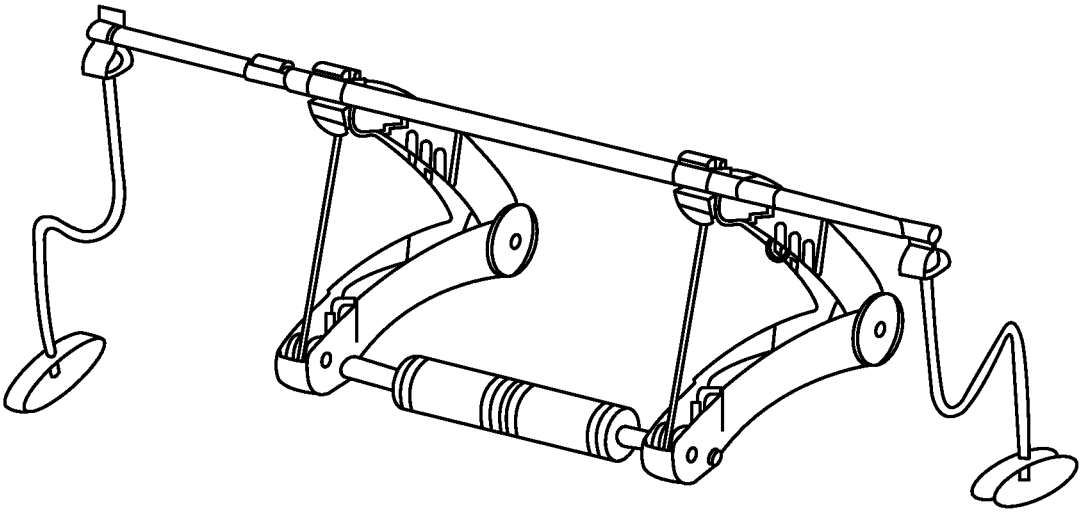
FIG. 9 is the multi-function exercise device of FIG. 8, but shown with the resistance bands of the arm bar released and hanging down freely, to expose the foot loops at each end thereof.
Figure 9A:
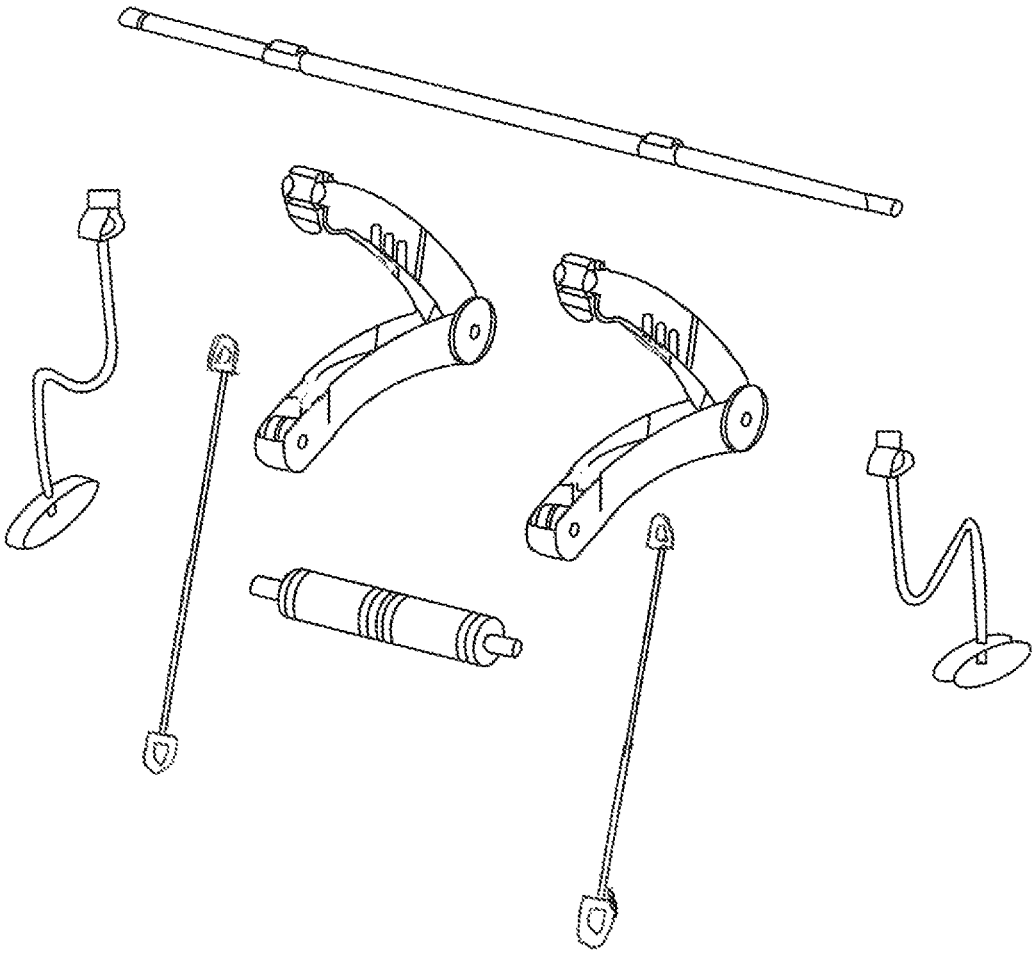
FIG. 9A is an exploded view showing the component parts of the multi-function exercise device of FIG. 9.
Figure 10:
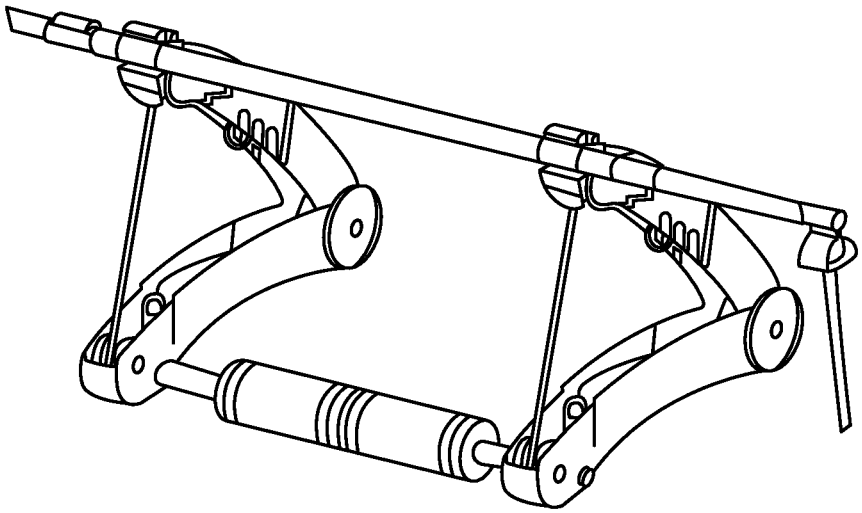
FIG. 10 is a perspective view of the multi-function exercise device of FIG. 8, but shown with an alternate embodiment of the arm bar that has flanges to inhibit its lateral movement relative to the support arms.
Figure 11:
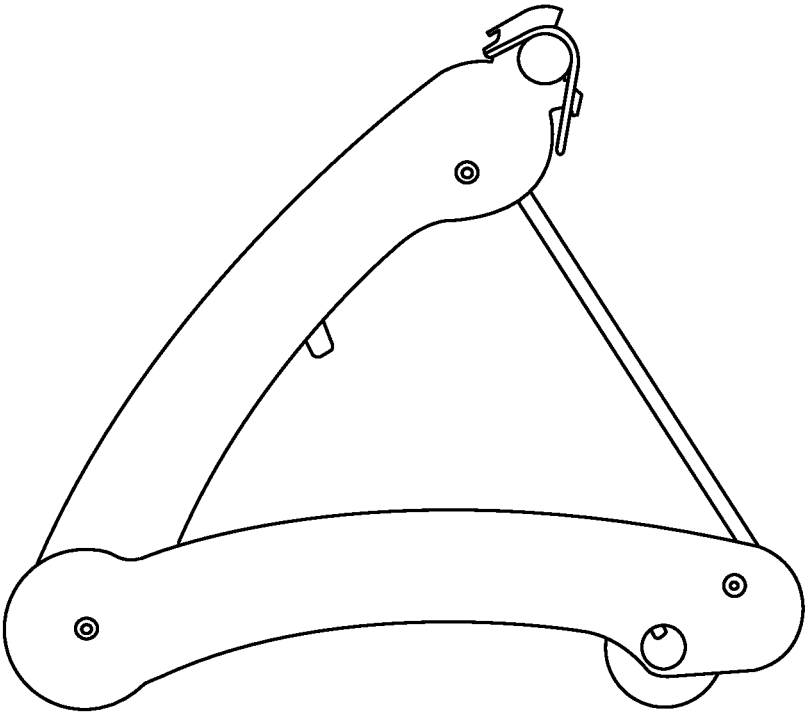
FIG. 11 is a cross-sectional view through the multifunction exercise device, showing a latch member that releasably secures the arm bar to one of the arms.

FIG. 5 and FIG. 7 show another embodiment for the arms, in which an arm 53 has a plurality of recesses (e.g., recesses 51/51A/51B) each configured to slidably receive a protrusion 13P' formed at the end of the resistance band 13'. The plurality of recesses permit adjustments of the securement location of one end of the resistance band to change the amount of resistance provided by the band. For example, when the protrusion 13P' is positioned within recess 51B it would provide less resistance than if positioned in recess 51A, and when the protrusion 13P' is positioned in recess 51 it would provide the greatest amount of resistance.

FIG. 5 shows an embodiment where the legs of the u-shaped frame would also have a plurality of recesses each configured to slidably receive a similarly formed/shaped protrusion at the other end of the resistance band, to provide for an even greater range of changes that may be made to the resistance provided by the band.

While illustrative implementations of one or more embodiments of the disclosed apparatus are provided hereinabove, those skilled in the art and having the benefit of the present disclosure will appreciate that further embodiments may be implemented with various changes within the scope of the disclosed apparatus. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A multi-function exercise device comprising:

a u-shaped member comprising a first leg, a second leg, and a leg bar between a first end of each of said first and second legs;

a first arm, a first end of said first arm being pivotally coupled to a second end of said first leg; a second end of said first arm comprising a recess;

a second arm, a first end of said second arm being pivotally coupled to a second end of said second leg; a second end of said second arm comprising a recess;

a first pair of resistance bands configured to apply resistance to pivotal movement between said first arm and said u-shaped member, and between said second arm and said u-shaped member;

a cross bar; said cross bar comprising: a first portion configured to be received in said recess at said second end of said first arm, and a second portion configured to be received in said recess at said second end of said second arm;

a first latch member and a second latch member; said first and second latch members configured to releasably secure said first and second portions of said cross bar in said first and second recesses, respectively;

a second pair of resistance bands; a first one of said second pair of resistance bands having a first end secured in proximity to a first end of said cross bar, and a second one of said second pair of resistance bands having a first end secured in proximity to a second end of said cross bar;

a first foot loop and a second foot loop, said first and second foot loops respectively secured to a second end of said second pair of resistance bands.

2. The multi-function exercise device according to claim 1, wherein when said cross-bar is releasably secured in said recesses at said second ends of said first and second arms, said device is usable for a first set of exercises; and wherein when said cross-bar is not secured in said recesses at said second ends of said first and second arms, said cross-bar with said second pair of resistance bands and said first and second loops is usable for a second set of exercises.

3. The multi-function exercise device according to claim 2, further comprising:

a first stop configured to limit pivotal movement of said first arm toward said u-shaped member to an acute angle.

4. The multi-function exercise device according to claim 3, further comprising:

a second stop configured to limit pivotal movement of said second arm toward said u-shaped member to said acute angle.

5. The multi-function exercise device according to claim 4, further comprising:

latch means for releasably inhibiting pivotal movement of at least said first arm with respect to said u-shaped member when at said acute angle.

6. The multi-function exercise device according to claim 5, further comprising:

a first reel configured for said first one of said second pair of resistance bands to be wound thereon; and a second reel configured for said second one of said second pair of resistance bands to be wound thereon.

7. The multi-function exercise device according to claim 6, further comprising a cushion positioned on said leg bar of said U-shaped member.

8. The multi-function exercise device according to claim 7, wherein each of said first and second latch members comprises a latch member from the group of latch members consisting of: a friction fit; a pivotable latch arm; and a flexible snap member.

9. A multi-function exercise device comprising:

a u-shaped member comprising a first leg, a second leg, and a leg bar between a first end of each of said first and second legs;

a first arm, a first end of said first arm being pivotally coupled to a second end of said first leg; a second end of said first arm comprising a recess;

a second arm, a first end of said second arm being pivotally coupled to a second end of said second leg; a second end of said second arm comprising a recess;

means for resisting pivotal movement of said first arm relative to said u-shaped member;

means for resisting pivotal movement of said second arm relative to said u-shaped member;

a cross bar comprising: a first portion configured to be received in said recess at said second end of said first arm, and a second portion configured to be received in said recess at said second end of said second arm;

means for latching said first portion of said cross bar in said first recess;

means for latching said second portion of said cross bar in said second recess;

a first resistance band and a second resistance band; said first resistance band having a first end secured in proximity to a first end of said cross bar, and said second resistance band having a first end secured in proximity to a second end of said cross bar;

a first foot loop and a second foot loop, said first and second foot loops respectively secured to a second end of said first and second resistance bands.

10. The multi-function exercise device according to claim 9, wherein when said cross-bar is releasably secured in said recesses at said second ends of said first and second arms, said device is usable for a first set of exercises; and wherein when said cross-bar is not secured in said recesses at said second ends of said first and second arms, said cross-bar with said second pair of resistance bands and said first and second loops is usable for a second set of exercises.

11. The multi-function exercise device according to claim 9, further comprising:

latch means for releasably inhibiting pivotal movement of at least said first arm with respect to said u-shaped member when at an acute angle.

12. The multi-function exercise device according to claim 9, further comprising:

a first reel configured for said first one of said second pair of resistance bands to be wound thereon; and a second reel configured for said second one of said second pair of resistance bands to be wound thereon.

* * * * *